US007995774B2

(12) United States Patent
Ise

(10) Patent No.: US 7,995,774 B2
(45) Date of Patent: Aug. 9, 2011

(54) SOUND FIELD CONTROL APPARATUS AND SOUND FIELD CONTROL METHOD

(75) Inventor: Tomohiko Ise, Iwaki (JP)

(73) Assignee: Alpine Electronics, Inc, Tokyo (JP)

( * ) Notice: Subject to any disclaimer, the term of this patent is extended or adjusted under 35 U.S.C. 154(b) by 602 days.

(21) Appl. No.: 12/186,295

(22) Filed: Aug. 5, 2008

(65) Prior Publication Data

US 2009/0169028 A1 Jul. 2, 2009

(30) Foreign Application Priority Data

Dec. 27, 2007 (JP) ..... 2007-336096

(51) Int. Cl.
*H04R 3/04* (2006.01)

(52) U.S. Cl. ..... 381/103; 381/71.4

(58) Field of Classification Search ..... 381/71.1, 381/71.4, 71.11, 71.12, 102, 103
See application file for complete search history.

(56) References Cited

U.S. PATENT DOCUMENTS 6,519,344 B1 2/2003 Yajima et al.

FOREIGN PATENT DOCUMENTS

JP 11168792 * 6/1999
JP 3539855 4/2004

* cited by examiner

*Primary Examiner* — Ramon Barrera
(74) *Attorney, Agent, or Firm* — Brinks Hofer Gilson & Lione

(57) ABSTRACT

In a sound field control apparatus including multiple speakers, multiple microphones gathering sound radiated from the multiple speakers, a mode decomposition filter that performs mode decomposition on a sound pressure distribution, and a control filter that controls the input signals to be input to the multiple speakers such that the mode amplitudes of the modes decomposed by the mode decomposition filter can have a predetermined value, a sound pressure distribution in the acoustic space is measured, and the sound pressure distribution in the acoustic space is expressed by using a sinusoidal function and cosine function of a space frequency of the mode to be controlled in amplitude. The mode space frequency is corrected such that the expressed sound pressure distribution can be equal to the measured sound pressure distribution, and the filter coefficient for the mode decomposition filter is determined based on the mode space frequency obtained by the correction (corrected mode space frequency).

15 Claims, 16 Drawing Sheets

SOUND FIELD CONTROL APPARATUS AND SOUND FIELD CONTROL METHOD

BACKGROUND OF THE INVENTION

RELATED APPLICATION

The present application claims priority to Japanese Patent Application Number 2007-336096, filed Dec. 27, 2007, the entirety of which is hereby incorporated by reference.

FIELD OF THE INVENTION

The present invention relates to a sound field control apparatus and a sound field control method, and it particularly relates to a sound field control apparatus including multiple speakers that radiate input signals to an acoustic space and multiple microphones that gather sound radiated from the multiple speakers, performing mode decomposition on a sound pressure distribution based on the output signal of each of the microphones, and performing control such that the mode amplification of each mode can have a predetermined value, and a sound field control method therefor.

DESCRIPTION OF THE RELATED ART

Generally in an acoustic space, reflected waves and standing waves are caused by walls, and sound waves mutually interfere, which complicates and disorders the acoustic transfer functions. Particularly in a confined space such as the interior of a car surrounded by things that easily reflect sound, such as glass, because the influence of the reflected waves and standing waves is large, the disorder of the acoustic transfer functions greatly influence the hearing of sound. An adaptive equalization system is known as a technology for correcting the disorder of acoustic transfer functions. The adaptive equalization system can produce a predetermined sound field space at an arbitrary control point.

FIG. 13 is a diagram showing a configuration of the adaptive equalization system to be applied to an audio apparatus. The adaptive equalization system shown in FIG. 13 includes an audio source 500, a target response setting section 501, a microphone 502, a calculating section 504, an adaptive signal processing device 506 and a speaker 508. The audio source 500 includes a radio tuner and/or a CD player, for example, and outputs an audio signal x(n). The target response setting section 501 has the setting of a target response characteristic (impulse response) H and receives the input of an audio signal x(n) output from the audio source 500 and outputs the target response signal d(n) corresponding to it. The microphone 502 is placed at a listening location (or control point) in an acoustic space within a car and detects sound at the observation point and outputs a music signal d'(n). The calculating section 504 calculates an error between the music signal d'(n) output from the microphone 502 and the target response signal d(n) output from the target response setting section 501 and outputs an error signal e(n). The adaptive signal processing device 506 generates a signal y(n) for a minimum power of the error signal e(n). The speaker 508 radiates the sound based on the signal y(n) output from the adaptive signal processing device 506 into the acoustic space within a car.

The target response characteristic H of the target response setting section 501 is a characteristic for the sound field space to be reproduced. For example, the set characteristic may be a flat characteristic (a characteristic with a gain of 1) in all audio frequency bands with a delay time t that is equivalent to about half of the number of taps of an adaptive filter. In this case, the delay time t is for the adaptive filter to approximate the inverse characteristic of an acoustic system with high precision. In order to implement it, the target response setting section 501 having the target response characteristic sets 1 as the coefficient of the tap corresponding to the delay time t for an FIR (Finite Impulse Response) digital filter and sets 0 as the coefficients of the other taps.

The adaptive signal processing device 506 receives the input of an audio signal x(n) as a reference signal and the input of the error signal e(n) output from the calculating section 504, performs adaptive signal processing for a minimum power of the error signal e(n) and outputs a signal y(n). The adaptive signal processing device 506 includes an LMS (Least Mean Square) algorithm processing section 510, an adaptive filter 512 in an FIR digital filter configuration and a signal processing filter 514 that convolutes a transfer characteristic (transmission characteristic) C of an acoustic transfer system from the speaker 508 to a listening location into an audio signal x(n) and generates a reference signal (filtered reference signal) u(n) for use in the adaptive signal processing.

The LMS algorithm processing section 510 receives the input of the error signal e(n) at a listening location and the reference signal u(n) output from the signal processing filter and uses the signals to set a tap coefficient vector W for the adaptive filter 512 by using the LMS algorithm such that a music signal d'(n) at the listening location can be equal to a target response signal d(n). The adaptive filter 512 uses the tap coefficient vector W to perform digital filtering processing on the audio signal x(n) and outputs the signal y(n).

The convergence of the tap coefficient vector W for the adaptive filter 512 for a minimum power of the error signal e(n) as a result of the adaptation processing allows listening to music similar to that in a case where the music is heard in a space having the target response characteristic H set by the target response setting section 501.

By the way, the adaptive equalization system allows the listening of music with the same transmission characteristic as the target response characteristic H at a control point but does not at all guarantee the characteristics at points other than the control point. For that reason, many control points must be set, which requires many speakers for the control points, in order to listen to ideal music at many positions within an acoustic space with the adaptive equalization system. Providing many speakers as controlled audio sources increases the number of adaptive filters 512 required therefor, which may increase the circuit scale and/or the amount of calculation.

Accordingly, a sound field control apparatus has been proposed that can correct a transmission characteristic in the entire acoustic space with fewer speakers and adaptive filters (refer to Japanese Patent No. 3539855). The sound field control apparatus allows the placement of multiple speakers and multiple microphones at predetermined positions within an acoustic space, performs mode decomposition on a sound pressure distribution based on the output signal by each of the microphones, and performs control such that the mode amplitude of each mode can have a predetermined value. In other words, by controlling the mode amplitude of each mode, the influence by modes for which the sound pressure varies largely when the listening location is moved can be decreased or cancelled. Therefore, without increasing the number of control points (listening locations) and with fewer speakers and adaptive filters, the transmission characteristic of the entire acoustic space can be corrected, which produces a flat sound pressure distribution.

FIGS. 14A to 14D are diagrams showing an amplitude state of modes. FIG. 14A is an amplitude state of Order 0 mode, FIG. 14B is an amplitude state of Order 1 mode, FIG. 14C is an amplitude state of Order 2 mode and FIG. 14D is an amplitude state of Order 3 mode. As indicated by the letter a in FIG. 15, audio sound can be listened to at an equal sound pressure level, independent of the listening locations, since the vibrations at Order 0 mode have an equal phase in the entire audio space. However, as indicated by the letters b and b', the sound pressure level largely varies according to the listening location. Therefore, in a case where the component of Order 1 mode is larger within the sound radiated in an audio space, it can be decreased or cancelled. Thus, a sound field with substantially equal acoustic characteristics can be obtained even at different listening location. The same is true for Order 2 mode and higher modes. If the order component equal to or higher than order 2 is large, control is performed to decrease or cancel the component. In FIG. 15, SPK refers to a speaker and STF and STR refer to a front seat and a rear seat, respectively.

FIG. 16 is an explanatory diagram of a conventional sound field control. In order to control the mode of an acoustic space, the mode decomposition must be performed on a sound pressure distribution. The wave equation for a one-dimensional sound field 1 with both ends closed, which internally has M audio sources (speakers) 2 as shown in FIG. 16, is given by:

$$p(x,\omega)=\sum_{n}^{N'}\sqrt{2-\delta(n')}\cos\left(\frac{n'\pi x}{L}\right)\times \frac{\rho_0 c_0^2}{L}\frac{\omega}{2\xi_{n'}\omega_{n'}\omega-j(\omega_{n'}^2-\omega^2)}\frac{1}{L}\sum_{m=1}^{M}\sqrt{2-\delta(n')}\cos\left(\frac{n'\pi l_m}{L}\right)q_m(\omega)=\sum_{n'=0}^{N'}(\psi_{n'}(x)\cdot a_{n'}(\omega)) \quad \text{[EQ 1]}$$

where x is the position of a microphone, ω is an angular frequency, p(x,ω) is a sound pressure, $q_m$ is an input signal to the mth speaker, $\mathbf{1}_m$ is the position of the mth speaker, M is the number of all speakers, $\xi_n'$ is the damping ratio on the wall surface of the n'th mode, N' is the number of all modes, L is the length of a sound field, $\omega_n'(=n'\pi c_0/L)$ is each unique frequency of a sound field, $\rho_0$ is an air density, $c_0$ is a sound velocity, and δ(n') is a Kronecker delta function, which is 1 when n'=0 and 0 when n'≠0. The expression "one-dimensional sound field" refers to a sound field in which a sound pressure varies only according to a predetermined axial direction x.

In [EQ1], $$a_{n'}(\omega)=\frac{\rho_0 c_0^2}{L}\frac{\omega}{2\xi_{n'}\omega_{n'}\omega-j(\omega_{n'}^2-\omega^2)}\frac{1}{L}\sum_{m=1}^{M}\sqrt{2-\delta(n')}\cos\left(\frac{n'\pi l_m}{L}\right)q_m(\omega); \quad \text{[EQ 2]}$$

and $$\psi_{n'}(x)=\sqrt{2-\delta(n')}\cos\left(\frac{n'\pi x}{L}\right) \quad \text{[EQ 3]}$$

where $a_n'(\omega)$ is an amplitude of the n'th mode, and $\psi_n'(x)$ is a natural mode function of the n'th mode. In [EQ1] as described above, since p(x,ω) is a sound pressure at the distance x of a microphone within a one-dimensional sound field, the sound pressure p(x,ω) at each microphone of microphones placed at K points ($x_1$, $x_2$, . . . and $x_K$) within a one-dimensional sound field is expressed in the matrix notation as follows:

$$\begin{bmatrix} p(x_1,\omega)\\ p(x_2,\omega)\\ \vdots\\ p(x_K,\omega)\end{bmatrix}=\begin{bmatrix}\psi_{01} & \psi_{11} & \cdots & \psi_{(N'-1)1}\\ \psi_{02} & \psi_{12} & \cdots & \psi_{(N'-1)2}\\ \vdots & \vdots & \vdots & \vdots\\ \psi_{0K} & \psi_{1K} & \cdots & \psi_{(N'-1)K}\end{bmatrix}\begin{bmatrix}a_0(\omega)\\ a_1(\omega)\\ \vdots\\ a_{N'-1}(\omega)\end{bmatrix} \quad \text{[EQ 4]}$$

where $$\psi_{nk}=\sqrt{2-\delta(n')}\cos\left(\frac{n'\pi x_k}{L}\right) \quad \text{[EQ 5]}$$

Rewriting [EQ4] by using the natural mode function ψ:

$$p=\psi * a \quad \text{[EQ6]}$$

Multiplying both sides of [EQ6] by the inverse matrix (inverse natural mode function) $\Psi^{-1}$ of the unique matrix (or natural mode matrix) provides:

$$a=\Psi^{-1} * p \quad \text{[EQ7]}$$

[EQ7] can provide the amplitude $a_n'(\omega)$ of each mode from the sound pressure $p(x_k,\omega)$ at each microphone. Mode decomposition is performed on a sound pressure distribution by the following steps.

FIG. 17 is a diagram showing a specific example of a mode decomposition unit, which is configured by applying a mode decomposition method. A mode decomposition unit 10 shown in FIG. 17 includes M speakers 2, K microphones 4 and a mode decomposition filter 6 that derives N mode amplitudes from the sound pressures at the microphones 4. The sound pressures $p_1$ to $p_K$ at the microphones 4, in a case where signals $q_1$ to $q_m$ are input to the M speakers 2 and sound is radiated to a one-dimensional sound field of an acoustic system C, are given by [EQ4]. The mode decomposition filter 6 receives the input of the sound pressures $p_1$ to $p_K$ and calculates and outputs the mode amplitudes $a_0$ to $a_{N-1}$ for Mode 0 to Mode N-1 by [EQ7].

Having described the mode control for a one-dimensional sound field above, the same is true for a two-dimensional sound field and a three-dimensional sound field. Instead of [EQ1], the wave equation for a three-dimensional sound field is:

$$p(x_1,x_2,x_3,\omega)=\sum_{n_1',n_2',n_3'=0}^{N''}\sqrt{2-\delta(n_1')}\sqrt{2-\delta(n_2')}\sqrt{2-\delta(n_3')}\cdot\cos\left(\frac{n_1'\pi x_1}{L_1}\right)\cos\left(\frac{n_2'\pi x_2}{L_2}\right)\cos\left(\frac{n_3'\pi x_3}{L_3}\right)\cdot\frac{\rho_0 c_0^2}{L_1L_2L_3}\frac{\omega}{2\xi_{n_1',n_2',n_3'}\omega_{n_1',n_2',n_3'}\omega-j(\omega_{n_1',n_2',n_3'}^2-\omega^2)}. \quad \text{[EQ 8]}$$

-continued $$\frac{1}{L_1L_2L_3}\sum_{m=1}^{M}\sqrt{2-\delta(n_1')}\sqrt{2-\delta(n_2')}\sqrt{2-\delta(n_3')}\cdot\cos\left(\frac{n_1'\pi l_{1m}}{L_1}\right)\cos\left(\frac{n_2'\pi l_{2m}}{L_2}\right)\cos\left(\frac{n_3'\pi l_{3m}}{L_3}\right)q_m(\omega)$$

$$=\sum_{n_1',n_2',n_3'=0}^{N''}(\psi_{n_1',n_2',n_3'}(x_1,x_2,x_3)\cdot a_{n_1',n_2',n_3'}(\omega))$$

where $X_1$, $X_2$ and $X_3$ are longitudinal, lateral and height positions of a microphone, respectively, ω is an angular frequency, $p(X_1,X_2,X_3,\omega)$ is a sound pressure, $q_m$ is an input signal to the mth speaker, $\mathbf{1}_{1m}$, $\mathbf{1}_{2m}$ and $\mathbf{1}_{3m}$ are longitudinal, lateral and height positions of the mth speaker, M is the number of all speakers, $\xi_{n'1}$, $\xi_{n'2}$ and $\xi_{n'3}$ are damping ratios on the wall surface of the $n'_1$th, $n'_2$th and $n'_3$th modes, N' is the number of all modes, $L_1$, $L_2$ and $L_3$ are longitudinal, lateral and height lengths of a sound field, respectively, $\omega_{n'1,n'2,n'3}$ $(=\pi c_0\{(n'_1/L_1)^2+(n'_2/L_2)^2+(n'_3/L_3)^2\})$ is a unique frequency of a sound field, $\rho_0$ is an air density and $c_0$ is a sound velocity.

In the conventional technology above, the natural mode function to be used for creating an acoustic space mode decomposition filter is:

$$\psi_{nk}=\sqrt{2-\delta(n_1')}\sqrt{2-\delta(n_2')}\sqrt{2-\delta(n_3')}\cos\left(\frac{n_1'\pi x_{k1}}{L_1}\right)\cos\left(\frac{n_2'\pi x_{k2}}{L_2}\right)\cos\left(\frac{n_3'\pi x_{k3}}{L_3}\right) \quad \text{[EQ 9]}$$

The requirement for use of the natural mode function is that the standing wave has a maximum amplitude at the position on a wall (which is a wall at the front end or rear end in a one-dimensional sound field) and is satisfied if facing walls are parallel and sonic waves are reflected entirely. However, the facing front and rear glass surfaces or left and right glass surfaces within an actual car are not parallel. The sound at a low frequency particularly is transmitted to the outside of a car. This is not the situation that can use [EQ9]. In other words, the conventional technology assumes an ideal condition that provides the sound pressure in the Order-1 mode within a car such that the sound pressure level can be 0 at the center in the front-rear direction, focusing on the Order-1 mode, and the absolute values of the sound pressure levels at the front end G and the rear end R can be equal, as shown in FIG. 18. However, in reality, as shown in FIG. 19 (which shows the absolute values of sound pressures), the sound pressure level at the Order- I mode within a car has the lowest level position closer to the front direction than the center. The absolute values of the sound pressure levels at the front end F and the rear end R are different and have a large difference, which deviates from the ideal state. Nevertheless, since the conventional technology uses [EQ9] for creating a mode decomposition filter, the amplitude of a mode space frequency may not be decomposed accurately, and a desired performance cannot be obtained, which is a problem.

SUMMARY OF THE INVENTION

Accordingly, it is an object of one embodiment of the present invention to allow the control of an acoustic space mode (standing waves) without decreasing the performance level even in a case where the function using an acoustic space mode decomposition filter does not satisfy an ideal condition within an actual car.

It is another object of an embodiment of the present invention to accurately determine a natural mode function in consideration of an actual sound pressure characteristic within a car.

It is another object of an embodiment of the present invention to create a mode decomposition filter by using a natural mode function in consideration of an actual sound pressure characteristic within a car.

It is another object of an embodiment of the present invention to provide control so as to accurately decompose the amplitude at a mode space frequency with a mode decomposition filter and obtain a desired sound pressure distribution (or flat sound pressure distribution).

-Sound Field Control Apparatus

According to a first embodiment of the invention, there is provided a sound field control apparatus that has multiple speakers radiating input signals to an acoustic space and multiple microphones gathering sound radiated from the multiple speakers, performs mode decomposition on a sound pressure distribution based on the signals output by the microphones, and provides control such that the mode amplitudes of modes can have a predetermined value. The sound field control apparatus includes a mode decomposition filter that performs mode decomposition on a sound pressure distribution based on signals output by the multiple microphones, a control filter that controls the input signals to be input to the multiple speakers such that the mode amplitudes of the modes decomposed by the mode decomposition filter can have a predetermined value, and a sound pressure distribution simulating section that measures a sound pressure distribution in the acoustic space, simulates a sound pressure distribution in the acoustic space by using a sinusoidal function and cosine function of a space frequency of the mode to be controlled in amplitude and corrects the mode space frequency such that the simulated sound pressure distribution can be equal to the measured sound pressure distribution, wherein the mode decomposition filter is created based on the obtained mode space frequency.

The sound pressure distribution simulating section may have a sound pressure distribution expressing section that expresses a sound pressure distribution in the acoustic space by generalized harmonic analysis by using the mode space frequency and the amplitudes of the sinusoidal function and cosine function as parameters, and a parameter determining section that corrects a mode space frequency such that the expressed sound pressure distribution can be equal to the measured sound pressure distribution and determines the amplitudes of sinusoidal function and cosine function by using the corrected mode space frequency.

The sound pressure distribution simulating section may have an impulse response measuring section that radiates measurement sound from speakers and measures impulse responses to the microphones, a transmission characteristic obtaining section that performs Fourier transform on the impulse responses and obtains transmission characteristics, a first sound pressure calculating section that calculates the sound pressure of the mode to be controlled in amplitude at each microphone by using the transmission characteristic, a sound pressure distribution expressing section that expresses a sound pressure distribution in the acoustic space by generalized harmonic analysis by using the mode space frequency and the amplitudes of the sinusoidal function and cosine function as parameters, a second sound pressure calculating section that calculates a sound pressure of the mode to be controlled in amplitude at each of the microphones by using the amplitudes of the sinusoidal function and cosine function, and a parameter determining section that corrects the mode space frequency such that the total sum of the powers of the differences in sound pressure, which are calculated by the first and second sound pressure calculating sections, at the microphones can be minimum and determines the amplitudes of the sinusoidal function and cosine function by using the corrected mode space frequency.

The sound field control apparatus may further include a mode space frequency calculating section that calculates a mode space frequency of the mode to be controlled in amplitude, wherein the parameter determining section adjusts the mode space frequency in the expression by generalized harmonic analysis within a predetermined range including the calculated mode space frequency, obtains a mode space frequency such that the total sum of the powers can be minimum and handles the mode space frequency as the corrected mode space frequency.

The sound field control apparatus may further include a mode center frequency calculating section that calculates the mode center frequency of the mode to be controlled in amplitude, wherein the first sound pressure calculating section calculates a real part and an imaginary part of the transmission function at the mode center frequency of the mode to be controlled in amplitude and, if the real part is positive, outputs the square root of the sum of the squares of the real part and imaginary part as a positive sound pressure and, if it is negative, outputs the square root as a negative sound pressure.

The sound field control apparatus may further include a mode center frequency calculating section that calculates the mode center frequency of the mode to be controlled in amplitude, wherein the first sound pressure calculating section has a mode center frequency correcting section that obtains a frequency at which the difference in sound pressure among the microphones can be maximum in a predetermined frequency range, which is lower than the mode center frequency, and corrects the mode center frequency with the frequency, and a sound pressure calculating section that calculates a real part and an imaginary part of the transmission function at the corrected mode center frequency and, if the real part is positive, outputs the square root of the sum of the squares of the real part and imaginary part as a positive sound pressure and, if it is negative, outputs the square root as a negative sound pressure.

-Sound Field Control Method

According to a second embodiment of the invention, there is provided a sound field control method that has multiple speakers radiating input signals to an acoustic space, multiple microphones gathering sound radiated from the multiple speakers, a mode decomposition filter that performs mode decomposition on a sound pressure distribution based on the signals output by the multiple microphones, and a control filter that controls the input signals to be input to the multiple speakers such that the mode amplitudes of the modes decomposed by the mode decomposition filter can have a predetermined value. The sound field control method includes a first act of measuring a sound pressure distribution in the acoustic space, a second act of simulating a sound pressure distribution in the acoustic space by using a sinusoidal function and cosine function of a space frequency of the mode to be controlled in amplitude, a third act of correcting the mode space frequency such that the simulated sound pressure distribution can be equal to the measured sound pressure distribution, and a fourth act of creating the mode decomposition filter based on the mode space frequency obtained by the correction (corrected mode space frequency).

The second act may include the act of expressing a sound pressure distribution in the acoustic space by generalized harmonic analysis by using the mode space frequency and the amplitudes of the sinusoidal function and cosine function as parameters, and the third act may include the act of correcting a mode space frequency such that the expressed sound pressure distribution can be equal to the measured sound pressure distribution and determining the amplitudes of sinusoidal function and cosine function by using the corrected mode space frequency.

The present invention as described above allows the control of an acoustic space mode (standing waves) without decreasing the performance level even in a case where the function using an acoustic space mode decomposition filter does not satisfy an ideal condition within an actual car by measuring a sound pressure distribution in an acoustic space, expressing the sound pressure distribution in the acoustic space by using a sinusoidal function and a cosine function of a space frequency of the mode to be controlled in amplitude, correcting the mode space frequency such that the expressed sound pressure distribution can be the measured sound pressure, and determining a filter coefficient for the mode decomposition filter based on the mode space frequency obtained by the correction.

A mode decomposition filter can be created in consideration of an actual sound pressure characteristic within a car, and the amplitude of a mode space frequency can be decomposed by the mode decomposition filter. As a result, a desired sound pressure distribution (which is a flat sound pressure distribution) can be created within the car.

According to the present invention, a natural mode function can be determined accurately in consideration of an actual sound pressure characteristic within a car by expressing a sound pressure distribution in the acoustic space by generalized harmonic analysis by using a mode space frequency and the amplitudes of a sinusoidal function and cosine function as parameters, correcting the mode space frequency such that the expressed sound pressure distribution can be equal to the measured sound pressure distribution, and determining the amplitudes of the sinusoidal function and cosine function by using the corrected mode space frequency. Since a filter coefficient for a mode decomposition filter is determined by using the natural mode function, the amplitude of the mode space frequency can be accurately decomposed. As a result, a desired sound pressure distribution (which is a flat sound pressure distribution) can be created within a car.

DESCRIPTION OF THE PREFERRED EMBODIMENTS (A) Car Interior Acoustic Space

Figure 1:
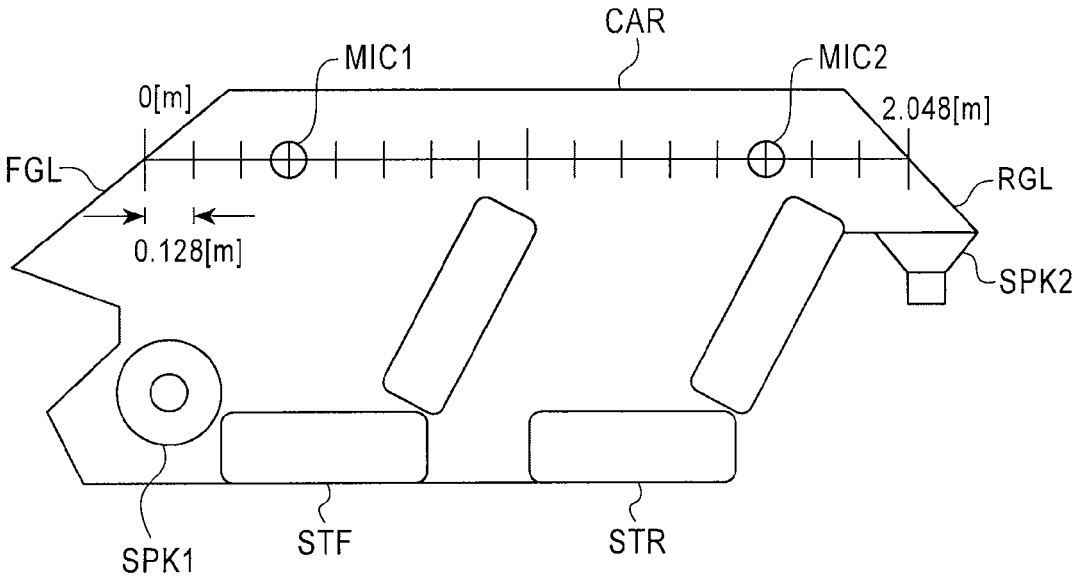
FIG. 1 is an explanatory diagram of a car interior acoustic space to which the present invention can be applied.

FIG. 1 is an explanatory diagram of a car interior acoustic space to which the present invention can be applied. For simple description, control over a one-dimensional sound field (in the front-rear direction of a car) will be described though it can be extended to a two-dimensional or a three-dimensional sound field as required.

The interior of a car includes two speakers SPKi (where i=1 or 2) and two microphones MICi (where i=1 or 2). The length 2.048 meters (m) in the front-rear direction is divided into 16, and numbers 1, 2, 3, . . . and 17 are assigned to the division points. In this case, the microphone MIC1 is placed at a listening point location at a predetermined height at Division Point 4, and the microphone MIC2 is placed at a listening location at a predetermined height at Division Point 14. The speaker SPK1 is provided at the front of the car, and the speaker SPK2 is provided at the rear of the car. The car includes front glass FGL and rear glass RGL and a front seat STF and a rear seat STR.

(B) Configuration of Mode Decomposition Filter Creating Apparatus

Figure 2:
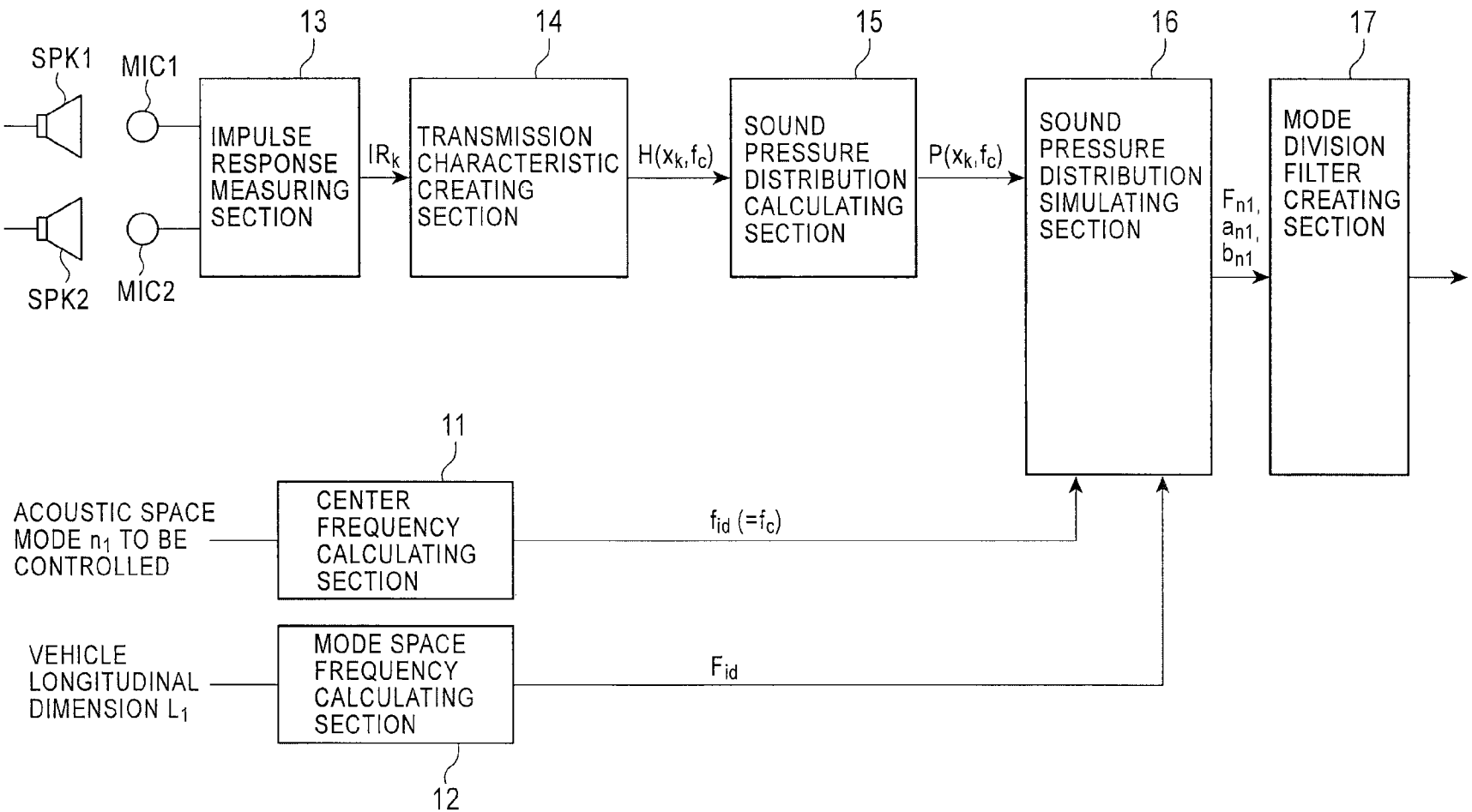
FIG. 2 is a configuration diagram of an apparatus that creates a mode decomposition filter according to the present invention.

FIG. 2 is a configuration diagram of an apparatus that creates a mode decomposition filter (refer to FIG. 17) of the invention. The same reference numerals are given to the same components as in FIG. 1. The creating apparatus expresses a real sound pressure distribution (refer to FIG. 19, for example) in an acoustic space by using a sinusoidal function and cosine function of a space frequency of the mode to be controlled in amplitude, corrects the mode space frequency and the amplitude values of the sinusoidal function and cosine function such that the expressed sound pressure distribution can be equal to the real sound pressure distribution, simulates the real sound pressure distribution with the mode space frequency (corrected mode space frequency) and amplitude values of the sinusoidal function and cosine function, which are obtained by the correction, and creates a mode decomposition filter based on the simulation result.

Figure 19:
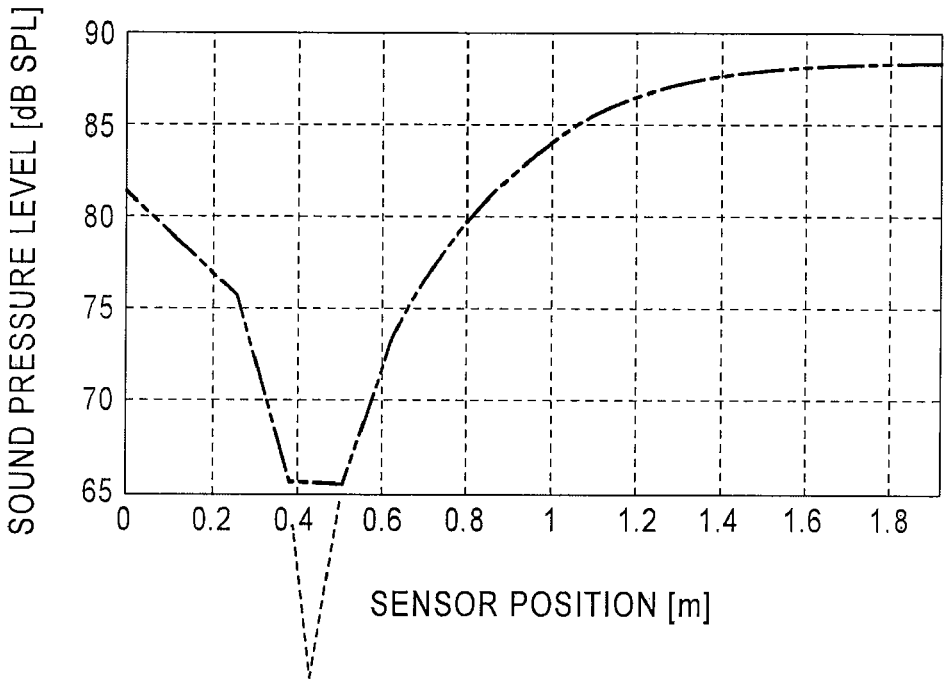
FIG. 19 shows sound pressure levels of Order-1 mode within a car.

In order to do so, a number of microphones equal to the number of acoustic space modes (standing waves) to be controlled are placed at equal intervals in an acoustic space. However, the Order-0 acoustic space mode is always to be controlled since it is a uniform sound field mode for all acoustic spaces. For that reason, two or more microphones must be placed at least. The microphones are placed on a horizontal section at a height at the listening point of a user and near one wall surface in the direction where the acoustic space mode to be controlled occurs. FIG. 1 is a layout example of the microphones in a case where the acoustic space modes to be controlled are the Order-O acoustic space mode and a one-dimensional space mode. In other words, if the sound pressure characteristic within the car is as shown in FIG. 19, the one-dimensional space mode is dominant among multiple acoustic space modes. Therefore, the Order-O acoustic space mode and the one-dimensional space mode are used here as the acoustic space modes to be controlled.

Next, the front-rear dimension of the horizontal section at the height of the listening point of a user is defined as $L_1$. The order $n_1$ (=1 in the example in FIG. 1) in the front-rear direction of the acoustic space mode to be controlled is defined.

A mode center frequency calculating section 11 calculates an ideal mode center frequency $f_{id}$ by:

$$f_{id} = \frac{c_0}{2}\left(\frac{n_1}{L_1}\right) \quad \text{[EQ 10]}$$

where the length $Lf_{id}$ of a one-dimensional sound field is expressed as fc.

A mode space frequency calculating section 12 calculates a mode space frequency $F_{id1}$ by:

$$F_{id1} = \frac{n_1}{2} \quad \text{[EQ 11]}$$

Figure 3A:
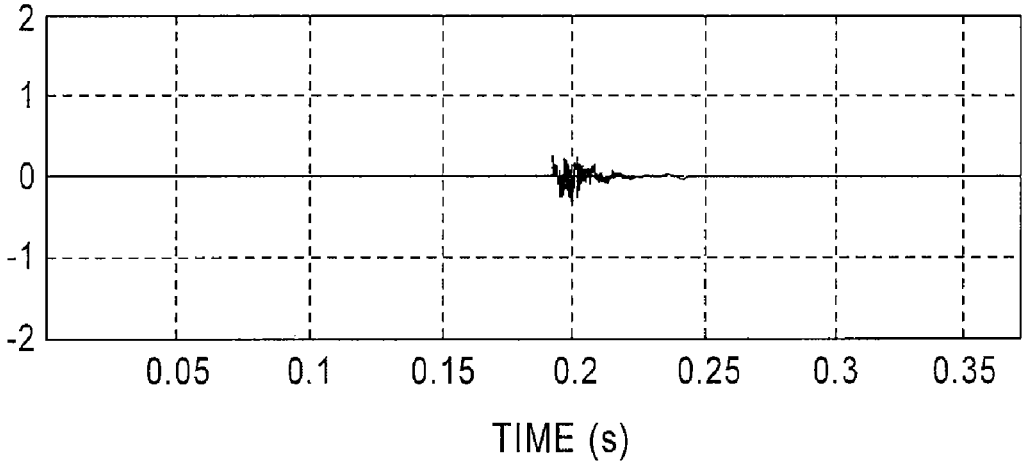
FIGS. 3A and 3B are impulse response examples.
Figure 3B:
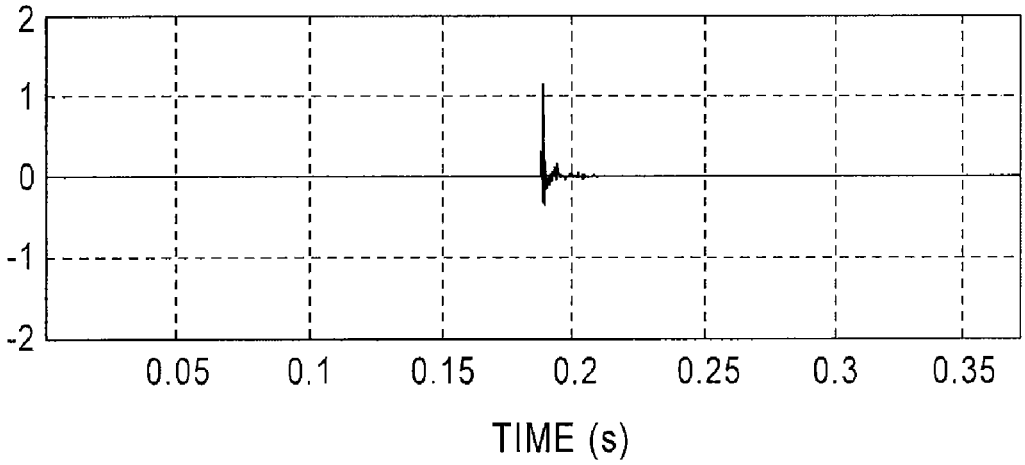

Next, in order to measure the transmission characteristic, the speakers SPK1 and SPK2 generate measurement sound at the same time, and an impulse response measuring section 13 measures impulse responses $IR_k$ (where k=1 or 2) from the detected signals from the microphones MIC1 and MIC2. FIG. 3A shows an impulse response example of the microphone MIC2 placed at Division Point 14, and FIG. 3B shows an impulse response example of the microphone MIC1 placed at Division Point 4.

A transmission characteristic creating section 14 performs Fourier transform on each of the measured impulse responses and obtains the transmission characteristic $H_k(x_k,fc)$ (where k=1 or 2). $x_k$(k=1 or 2) refers to coordinates of the position of a microphone. After obtaining the transmission characteristic of each of the microphones, a sound pressure distribution calculating section 15 calculates the sound pressure distribution $p(x_k,f_c)$ at a frequency $f_c$ based on:

$$p(x_k, f_c) = \begin{cases} \sqrt{\mathrm{Re}(H(x_k, f_c))^2 + \mathrm{Im}(H(x_k, f_c))^2} & \text{if } \mathrm{Re}(H(x_k, f_c)) \geqq 0 \\ -\sqrt{\mathrm{Re}(H(x_k, f_c))^2 + \mathrm{Im}(H(x_k, f_c))^2} & \text{if } \mathrm{Re}(H(x_k, f_c)) < 0 \end{cases} \quad \text{[EQ 12]}$$

where Re( ) refers to a real part of a complex number, and Im( ) refers to an imaginary number thereof.

In other words, the sound pressure distribution calculating section 15 calculates a real part and an imaginary part of the transfer function at a mode center frequency $f_c$ of the mode to be controlled in amplitude and, if the real part is positive, outputs the square root of the sum of the squares of the real part and the imaginary part as a positive sound pressure and, if it is negative, outputs the square root as a negative sound pressure.

Figure 14:
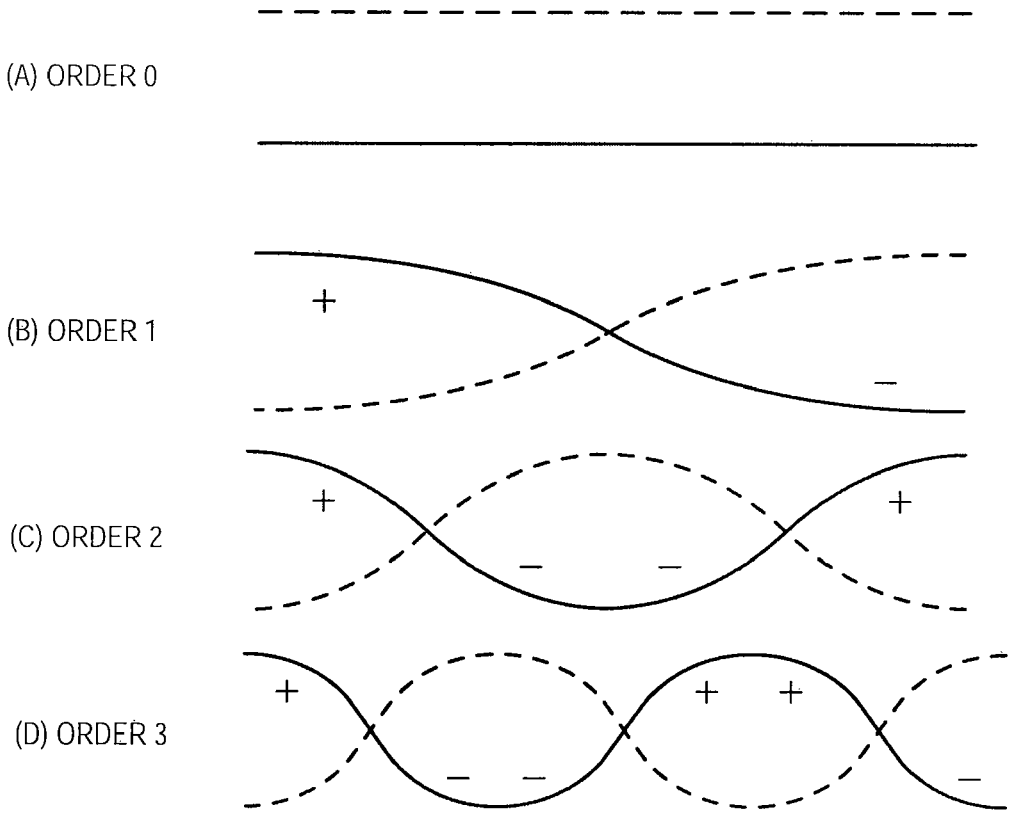
FIG. 14A-D are diagrams showing amplitude states of modes.
Figure 15:
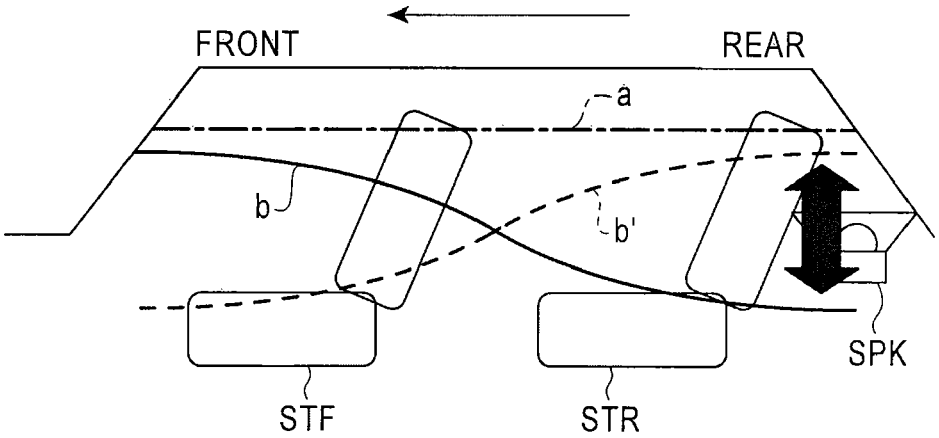
FIG. 15 is an explanatory diagram of a mode state in an acoustic space.
Figure 16:
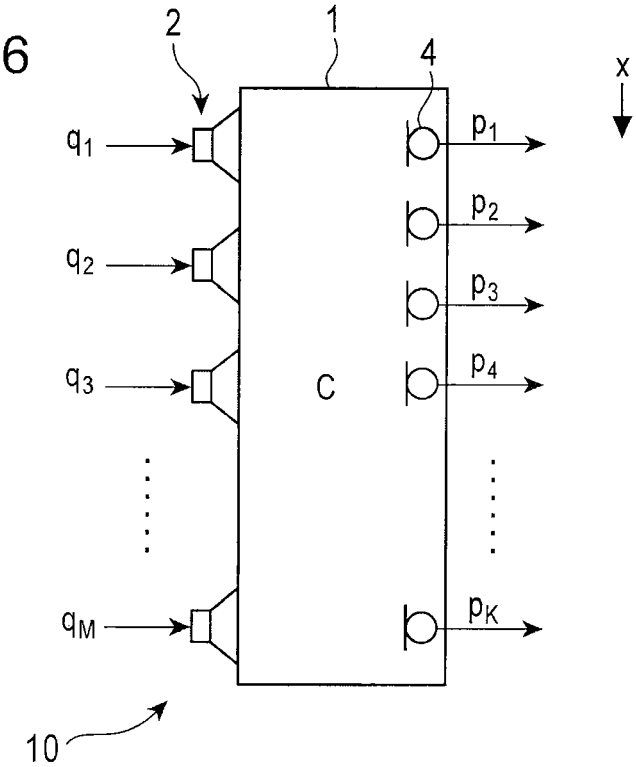
FIG. 16 is an explanatory diagram of conventional sound field control.

A sound pressure distribution simulating section 16 simulates a sound pressure distribution in an acoustic space within a car by generalized harmonic analysis by using a mode space frequency and the amplitudes of a sinusoidal function and cosine function as parameters. In other words, the interior of a car has multiple acoustic space modes (standing waves) as described with reference to FIG. 14, and they are synthesized to a sound pressure at a predetermined observation point within the car. For that reason, the acoustic characteristic of the interior of the car can be expressed by generalized harmonic analysis by using a mode space frequency, sinusoidal function and cosine function, and the sound pressure $p'(x,\omega)$ at a position x can be generally expressed by:

$$p'(x,\omega) = \sum_{n=1}^{N}\{a_n\cos(2\pi F_n x) + b_n\sin(2\pi F_n x)\} \quad \text{[EQ 13a]}$$

$$a_n = \frac{2}{K}\sum_{k=1}^{K}\{p(x_k, f_c)\cos(2\pi F_n x_k)\} \quad \text{[EQ 13b]}$$

$$b_n = \frac{2}{K}\sum_{k=1}^{K}\{p(x_k, f_c)\sin(2\pi F_n x_k)\} \quad \text{[EQ 13c]}$$

where k is the number of microphones, $x_k$ is a position of each of the microphones, N is the number of acoustic space modes, and $F_n$ is a mode space frequency at an acoustic space mode n. In this case, as shown in FIG. 1, N=1 in [EQ13a] if the acoustic space modes to be controlled are Order 0 and Order 1.

As shown in FIG. 19, the sound pressure characteristic of the interior of a car is similar to the sound pressure characteristic at Order 1 mode, but the phase is shifted forward. This means that the mode space frequency is shifted from $n_1/2$ (=0.5). Therefore, the sound pressure simulating section 16 adjusts $F_n$ in [EQ13a] within a predetermined range including $n_1/2$(=0.5), and adjusts the coefficients $a_n$ and $b_n$ of the sinusoidal function and cosine function such that the sound pressure distribution simulated by [EQ13a] can be equal to the measured sound pressure distribution $p(x_k,f_c)$.

That is, the one-dimensional space mode frequency $F_n$ is adjusted such that:

$$e^2(f_c) = \sum_{k=1}^{K}\{p(x_k, f_c) - p'(x_k, f_c)\}^2 \quad \text{[EQ 14]}$$

can be minimum. In other words, the sound pressure distribution simulating section 16 determines $F_n$, $a_n$ and $b_n$ such that the total sum of the square of the difference between a real sound pressure and a simulated sound pressure at each microphone position can be minimum and inputs them to a mode division filter creating section 17.

The mode division filter creating section 17 uses the input $F_n$, $a_n$ and $b_n$ (which will be expressed as $F_1$, $a_1$ and $b_1$ here) to obtain a unique function to be used for an acoustic space mode decomposition filter within an actual car by:

$$\psi_{nk} = \sqrt{2-\delta(n_1)}\left\{a_{n_1}\cos\left(\frac{2\pi F_{n_1}x_k}{L_1}\right) + b_{n_1}\sin\left(\frac{2\pi F_{n_1}x_k}{L_1}\right)\right\} \quad \text{[EQ 15]}$$

The mode division filter creating section 17 determines Ψ of the mode division filter in [EQ4] by the equation above. In the case in FIG. 1, Ψ of the mode division filter is determined by calculating the matrix elements in:

$$\Psi = \begin{bmatrix} \psi_{01} & \psi_{11} \\ \psi_{02} & \psi_{12} \end{bmatrix} \quad \text{[EQ 16]}$$

$\psi_{01}$ and $\psi_{02}$ are both 1, $\psi_{11}$ is the value of [EQ15] when the position $x_1$ of the first microphone MIC1 is input as $x_k$, and $\psi_{22}$ is the value of [EQ15] when the position $x_1$ of the second microphone MIC2 is input as $x_k$.

Figure 4:
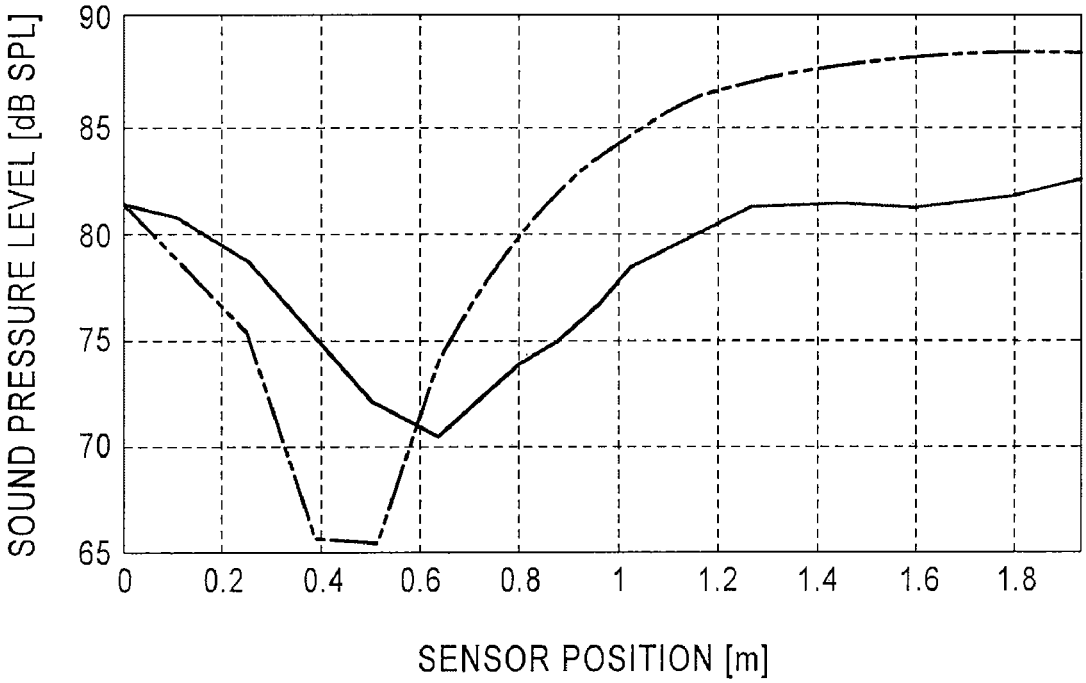
FIG. 4 is a sound pressure distribution characteristic obtained in the entire sound field according to the present invention.
Figure 17:
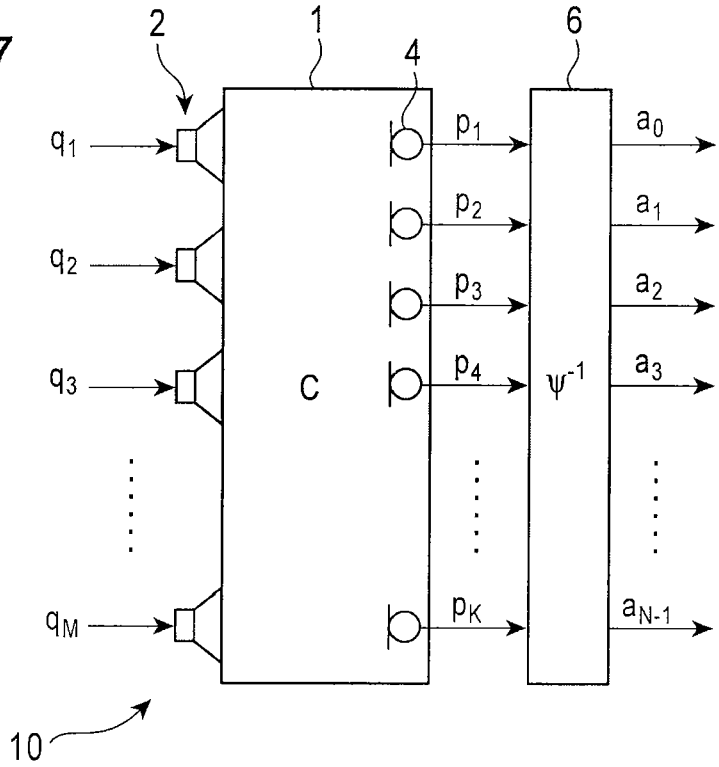
FIG. 17 is a diagram showing a specific example of a mode decomposition section, which is configured by applying a conventional mode decomposition method.
Figure 18:
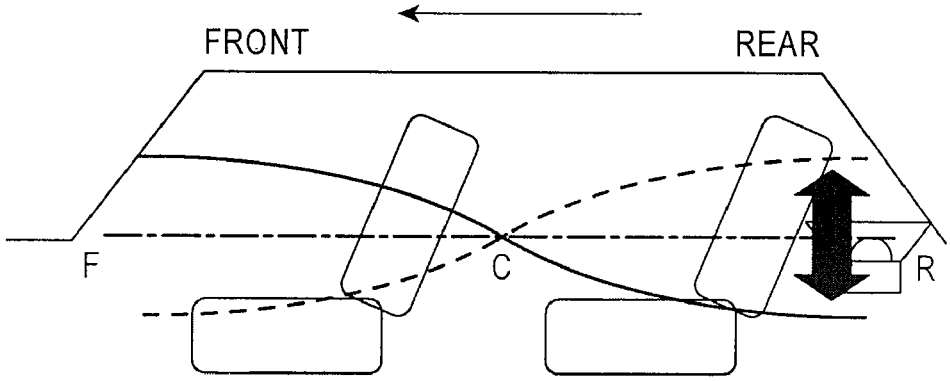
FIG. 18 is an explanatory diagram of sound pressure levels within a car.

Controlling the sound pressure by using the thus determined mode division filter as the mode division filter 6 in FIG. 17 can provide a sound pressure distribution characteristic which is nearly flat in the entire sound field, as indicated by the solid line in FIG. 4. In other words, the peek/dip on the sound pressure distribution after control can be reduced by about 10 dB compared with those before the control, which can provide a flatter characteristic.

Having described the case of a one-dimensional sound field above, it can be extended to a two-dimensional sound field and a three-dimensional sound field. In a case of a two-dimensional sound field, the unique function to be used in an acoustic space mode decomposition filter within a car is:

$$\psi_{nk} = \sqrt{2-\delta(n_1)}\sqrt{2-\delta(n_2)} \left\{a_{n_1}\cos\left(\frac{2\pi F_{n_1}x_{k_1}}{L_1}\right) + b_{n_1}\sin\left(\frac{2\pi F_{n_1}x_{k_1}}{L_1}\right)\right\} \times \left\{a_{n_2}\cos\left(\frac{2\pi F_{n_2}x_{k_2}}{L_2}\right) + b_{n_2}\sin\left(\frac{2\pi F_{n_2}x_{k_2}}{L_2}\right)\right\} \quad \text{[EQ 15a]}$$

where L1 and L2 are dimensions in the front-rear and left-right directions of a sound field, and $n_1$ and $n_2$ are the numbers of modes in the front-rear and left-right directions of the controlled acoustic space modes.

In a case of a three-dimensional sound field, the unique function to be used in an acoustic space mode decomposition filter within a car is:

$$\psi_{nk} = \sqrt{2-\delta(n_1)}\sqrt{2-\delta(n_2)}\sqrt{2-\delta(n_3)} \left\{a_{n_1}\cos\left(\frac{2\pi F_{n_1}x_{k_1}}{L_1}\right) + b_{n_1}\sin\left(\frac{2\pi F_{n_1}x_{k_1}}{L_1}\right)\right\} \times \left\{a_{n_2}\cos\left(\frac{2\pi F_{n_2}x_{k_2}}{L_2}\right) + b_{n_2}\sin\left(\frac{2\pi F_{n_2}x_{k_2}}{L_2}\right)\right\} \times \left\{a_{n_3}\cos\left(\frac{2\pi F_{n_3}x_{k_3}}{L_3}\right) + b_{n_3}\sin\left(\frac{2\pi F_{n_3}x_{k_3}}{L_3}\right)\right\} \quad \text{[EQ 15b]}$$

By doing so, the standing waves can be controlled without decreasing the performance level even if the function to be used in the acoustic space mode decomposition filter within a real car does not satisfy the ideal condition.

(C) Other Configurations of Mode Decomposition Filter Creating Apparatus

Figure 5:
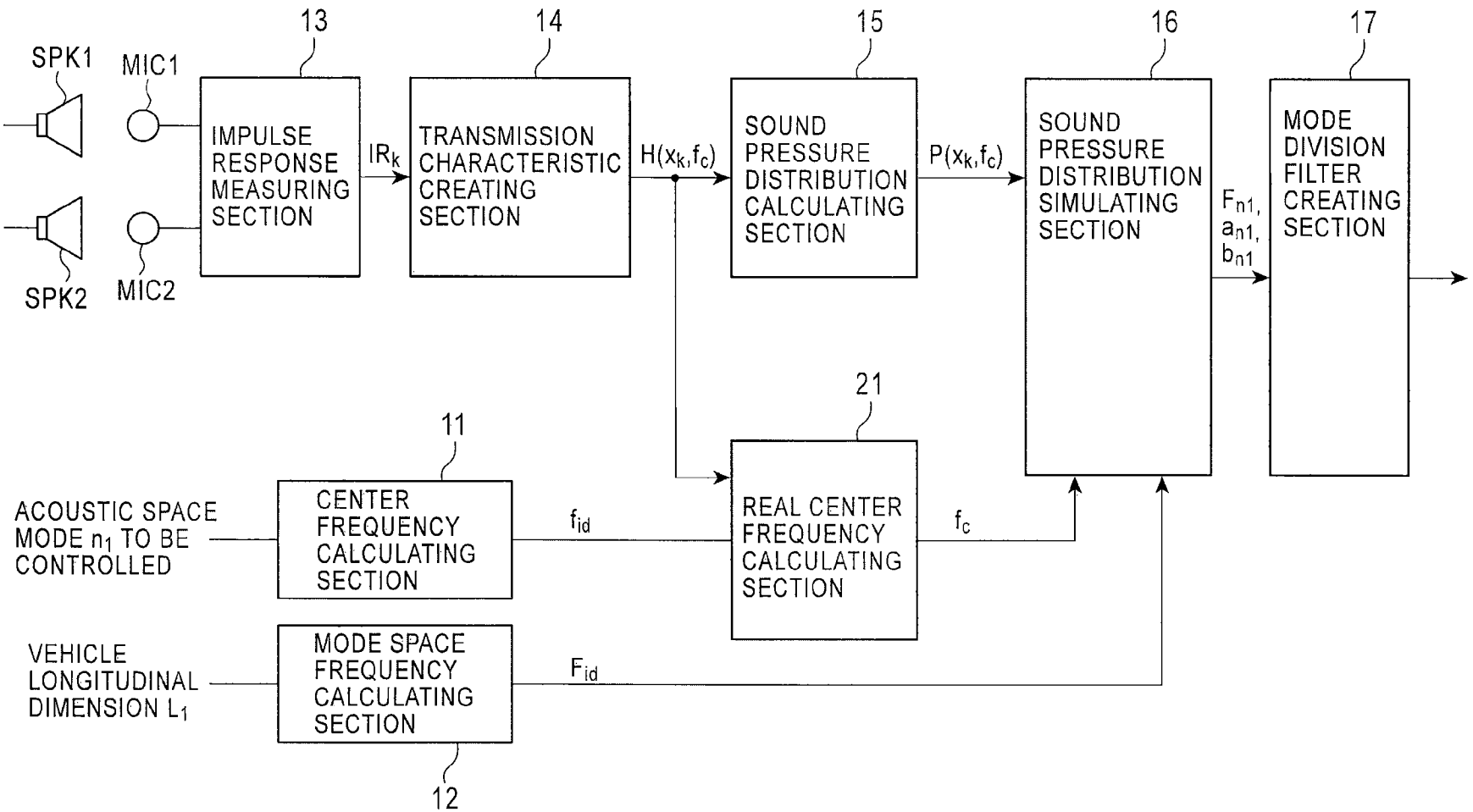
FIG. 5 is another configuration diagram of an apparatus that creates a mode decomposition filter according to the present invention.

FIG. 5 is another configuration diagram of an apparatus that creates a mode decomposition filter of the present invention, and the same reference numerals are given to the same components as those in FIG. 2. FIG. 5 and FIG. 2 are different in that there is further provided a real center frequency calculating section 21 that calculates a real mode center frequency. As apparent from FIG. 19, the absolute values of the sound pressure levels at both ends of the interior of a car are different. This is because the wavelengths are longer than a regular length, and the center frequency fc is also low.

Figure 6A:
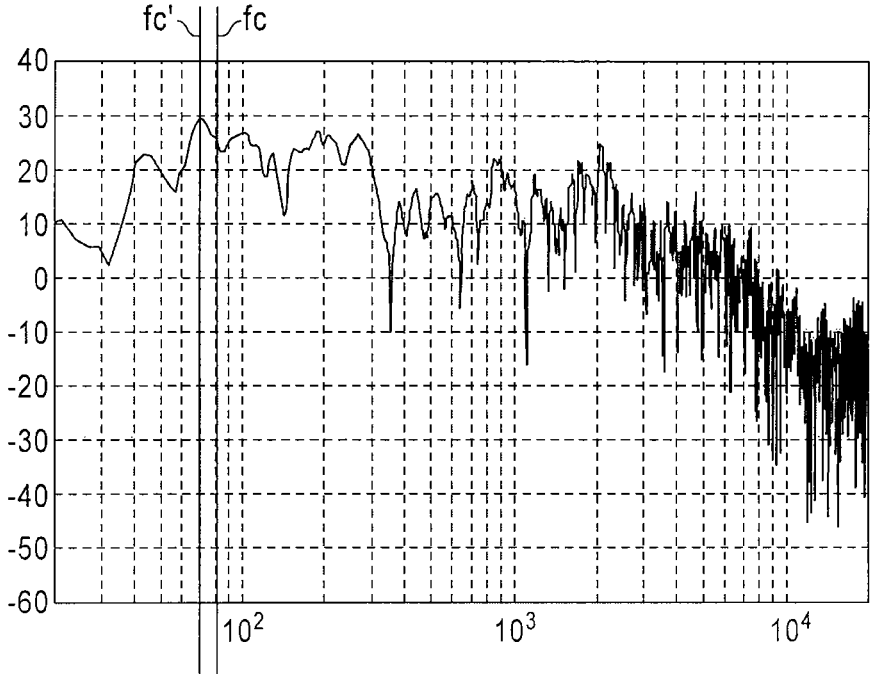
FIGS. 6A and 6B show transmission characteristics (or gain frequency characteristics)
Figure 6B:
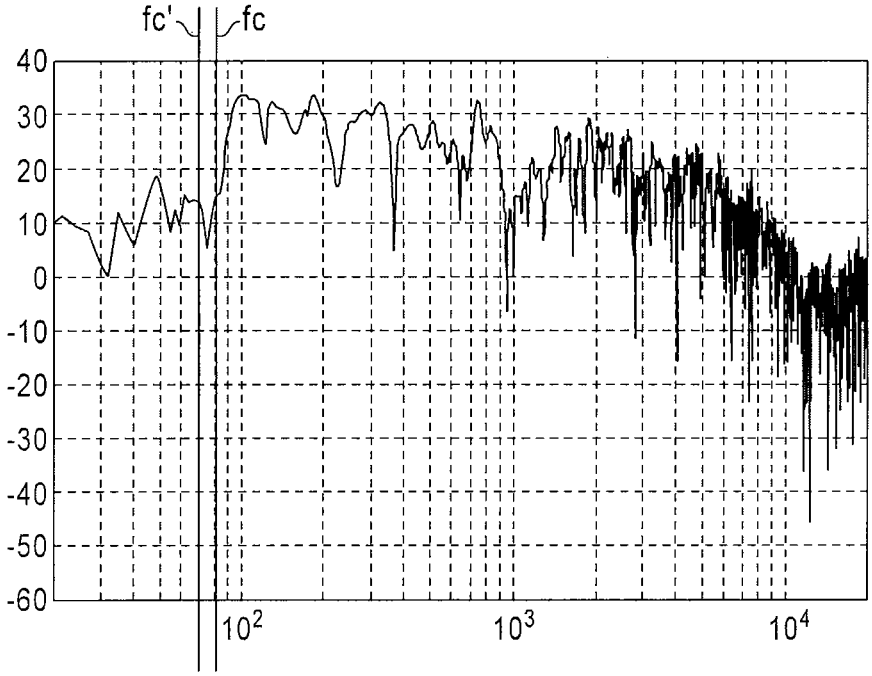

FIG. 6A shows a transmission characteristic (gain frequency characteristic) of the microphone MIC2, and FIG. 6B shows a transmission characteristic of the microphone MIC1. The transmission characteristic should have the peak at the ideal mode center frequency fc(=fid). However, the peak is shifted to the lower frequency side, compared with the case in FIG. 6A. In a first method, the center frequency is changed to a frequency fc' with the peak. Then, the same control as that by the first mode decomposition filter creating apparatus is performed by handling the frequency fc' as fc. By changing the mode center frequency in this way, the flat characteristic can be improved.

By the way, FIG. 6B does not show the peak at the frequency fc'. In a second method, the frequency, which is lower than and close to the ideal mode center frequency $f_{id}$ and at which the difference in sound pressure due to a difference in microphone position is maximum is used as the real mode center frequency. Then, the same control as that by the first mode decomposition filter is performed by handling the frequency as fc. In this way, by changing the mode center frequency, the flat characteristic can be improved.

Figure 7:
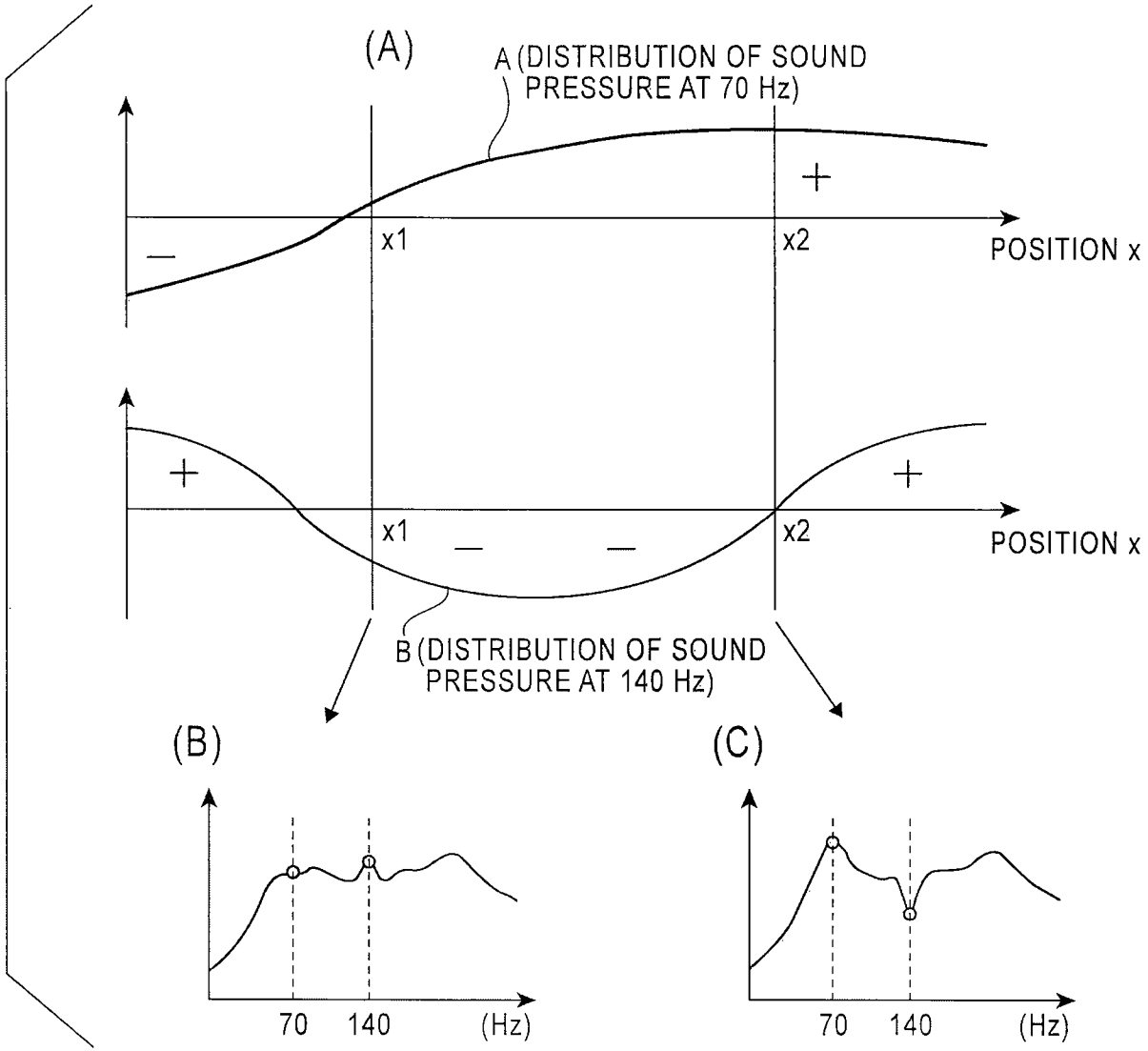
FIGS. 7A to 7C are explanatory diagrams for a mode center frequency determining method.

Referring to FIGS. 7A to 7C, the reason why the frequency with a maximum difference in sound pressure is used as a real mode center frequency is as follows. FIG. 7A shows a sound pressure distribution A at 70 Hz and a sound pressure distribution B at 140 Hz at positions within a car, FIG. 7B shows a frequency characteristic at a position x1, and FIG. 7C is a frequency characteristic at a position x2. As apparent from FIG. 7A, the sound pressure distribution within the acoustic space varies according to the frequency, which causes a peak and a dip on the frequency characteristic at the positions (such as x1 and x2) as shown in FIGS. 7B and 7C. It is an object to improve the flat characteristic of a sound pressure distribution, that is, to correct the sound pressure distribution of a frequency with the sound pressure distribution, which is largely different due to the positional difference. Therefore, the frequency with a large difference in sound pressure is adopted as the real mode center frequency.

(D) First Sound Field Control Apparatus

Figure 8:
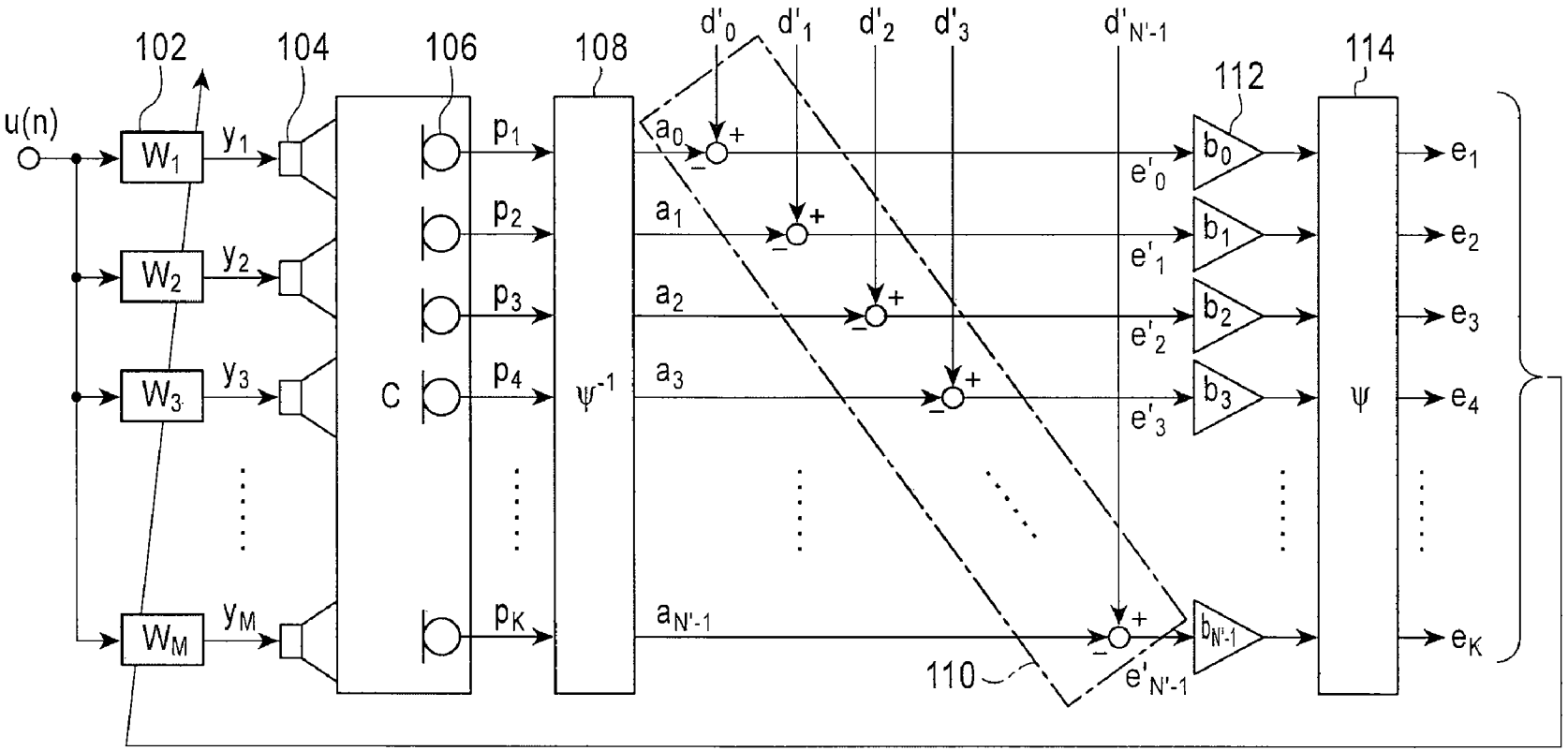
FIG. 8 is a diagram showing a schematic configuration of a first sound field control apparatus.

FIG. 8 is a diagram showing a schematic configuration of a sound field control apparatus according to a first embodiment. The sound field control apparatus includes the mode decomposition filter created in FIG. 2 or 5, and an adaptive filter to be controlled by an LMS algorithm that operates in the time domain.

In other words, the sound field control apparatus of the first embodiment includes a control filter 102 including M adaptive filters with I taps, M speakers 104, K microphones 106, a mode division filter 108 functioning as a mode decomposition means for deriving N' mode amplitudes from sound pressures p of the microphones 106, N' calculating sections 110 each of which calculates an error of each mode amplitude about a target mode amplitude, N' mode domain error weighting sections 112 each of which weights the error of each mode, and a domain conversion filter 114 that converts an error in the mode domain to an error in the time domain.

As the convolution of an input signal u(n) and a coefficient $W_m$ of the control filter 102, the output signal $y_m(n)$ of the mth control filter 102 is expressed by:

$$y_m(n) = \sum_{i=0}^{I-1} w_m(i)u(n-i) \qquad \text{[EQ 17]}$$

The output signal $y_m(n)$ is input to the mth speaker 104, and sound is radiated to a one-dimensional sound field of an acoustic system C and is captured by the microphones 106. The sound pressure $p_k(n)$ at the kth microphone 106 is given by:

$$\begin{aligned} p_k(n) &= \sum_{j=0}^{J-1} c_{km}(j) \sum_{i=0}^{I-1} w_m(i)u(n-i-j) \\ &= \sum_{i=0}^{I-1} w_m(i) \sum_{j=0}^{J-1} c_{km}(j)u(n-i-j) \end{aligned} \qquad \text{[EQ 18]}$$

where $c_{km}(j)$ is a coefficient of the jth tap in the acoustic system c from the mth speaker 104 to the kth microphone 106, and $W_m(i)$ is a coefficient of the ith tap of the mth control filter 102. Rewriting [EQ18] in a matrix expression:

$$p(n)=CU(c)w \qquad \text{[EQ19]}$$

The mode amplitude a(n) can be obtained by performing mode decomposition in the same manner as [EQ7] on the sound pressure p(n) at the microphone 106 obtained by [EQ19]. In other words, the mode division filter 108 derives the mode amplitude a(n) by the operation given by:

$$a(n)=\Psi^{-1}CU(n)w \qquad \text{[EQ20]}$$

On the other hand, the output $d_k(n)$ of the kth target impulse response output from a target response setting section (which will be described later) is given by:

$$d_k(n) = \sum_{s=0}^{S-1} h_k(s)u(n-s) \qquad \text{[EQ 21]}$$

where $h_k(s)$ is a coefficient of the sth tap of the kth target impulse response. Rewriting [EQ21] in a matrix expression:

$$d(n)=Hu''(n) \qquad \text{[EQ22]}$$

The mode amplitude d'(n) of the target response can be obtained by performing mode decomposition in the same manner as [EQ7] on the target response signal d(n) obtained by [EQ22]. Therefore, the mode amplitude d'(n) of the target response is:

$$d'(n)=\Psi^{-1}Hu''(n) \qquad \text{[EQ23]}$$

The error e'(n) in the mode domain can be obtained by subtracting the mode amplitude a(n) given by [EQ20] from the mode amplitude d'(n) of the target response given by [EQ23]. Therefore, the calculating section 110 derives the en-or e'(n) in the mode domain by the operation given by:

$$e'(n)=\Psi^{-}d(n)-\Psi^{-1}CU(n)w \qquad \text{[EQ24]}$$

Next, the mode domain error weighting section 112 performs weighting with weighting coefficients B(b0 to $b_{N-1}'$) on errors e'(n)($e'_0(n)$ to $e'_{N-1}(n)$) in the mode domain for selecting the mode to be controlled. The domain conversion filter 114 calculates the error e(n) in the time domain by multiplying the weighted error in the mode domain by the natural mode function Ψ. The weighting on the error e'(n) in the mode domain and the conversion from a weighted error in the mode domain to an error in the time domain are:

$$e(n) = \Psi B e'(n) \quad \text{[EQ 25]}$$
$$= \Psi B \Psi^{-1} d(n) - \Psi B \Psi^{-1} C U(n) w$$

In this case, calculating an instant estimate of the gradient vector of an error performance surface by performing partial differentiation with a filter coefficient w on an instant power $e(n)^T e(n)$ of an error vector e(n) in the time domain:

$$\partial e(n)^T e(n)/\partial w = -2U(n)^T C^T (\Psi^{-1})^T B^T \Psi^T e(n) \quad \text{[EQ26]}$$

Therefore, the coefficient of the control filter 102 is updated by:

$$w(n+1) = w(n) - \mu(\partial e(n)^T e(n)/\partial w) \quad \text{[EQ 27]}$$
$$= w(n) + 2\mu U(n)^T C^T (\Psi^{-1})^T B^T \Psi^T e(n)$$

where μ is a step size parameter of the LMS algorithm.

Figure 9:
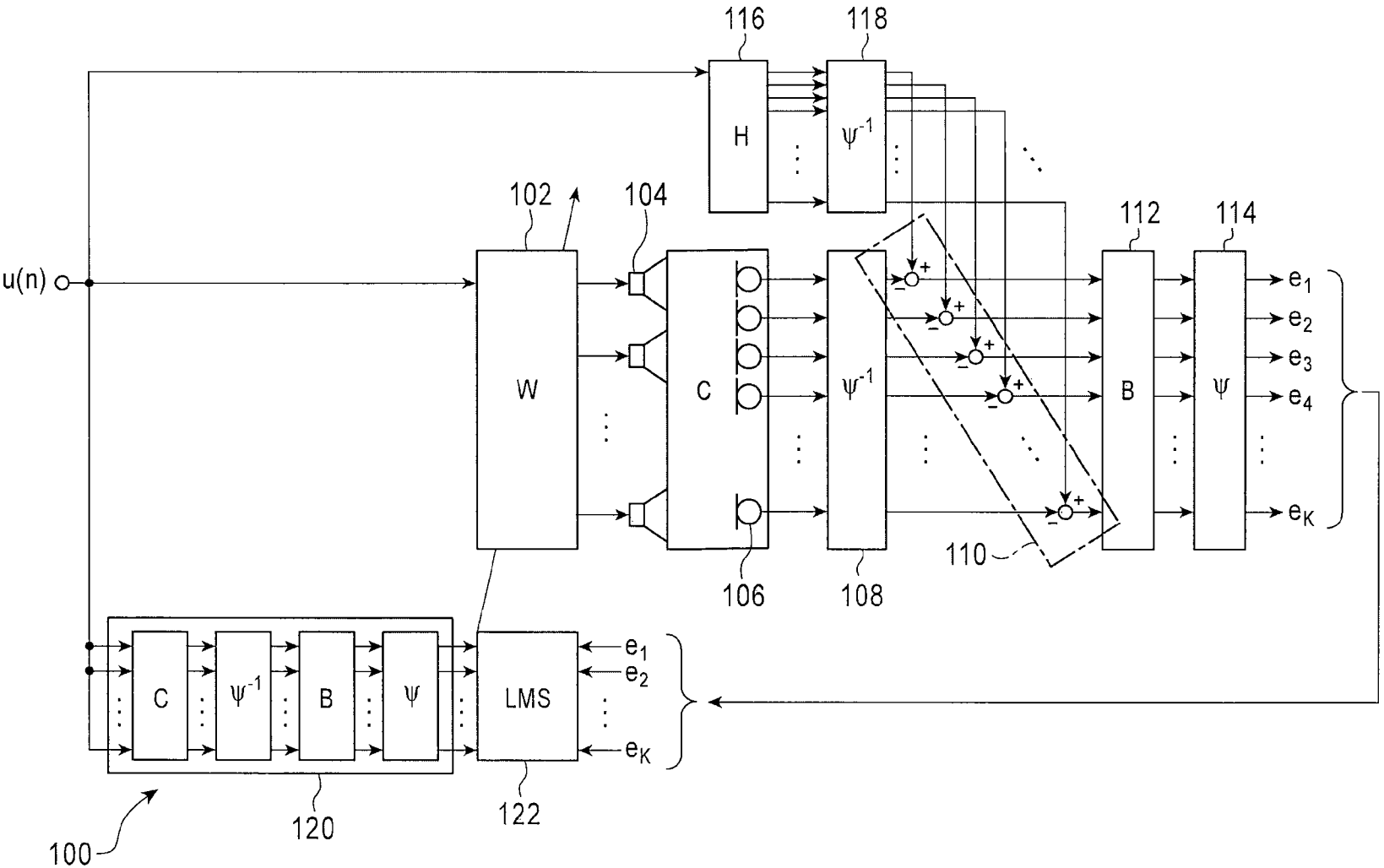
FIG. 9 is a diagram showing an entire configuration of the first sound field control apparatus.

FIG. 9 is a diagram showing an entire configuration of the first sound field control apparatus. As shown in FIG. 9, a sound field control apparatus 100 includes a control filter 102 including an adaptive filter with I taps, M speakers 104, K microphones 106, a mode division filter 108, N' calculating sections 110, N' mode domain error weighting sections 112, a domain conversion filter 114, a target response setting section 116, a mode division filter 118, a filtered x section 120 and an LMS algorithm processing section 122.

The control filter 102, speakers 104, microphones 106, mode division filter 108, calculating sections 110, mode domain error weighting sections 112 and domain conversion filter 114 perform the operations described with reference to FIG. 8.

The target response setting section 116 may have the setting of a characteristic corresponding to the sound field space to be reproduced (or the target response characteristic H), such as a characteristic having a delay time, which is equal to about half of the number of taps of the filters included in the control filter 102. The mode division filter 118 derives N' mode amplitudes from the target response signal output from the target response setting section 116 and outputs them to the calculating sections 110.

The filtered x section 120 is a filter for creating a reference signal from an input signal u(n). More specifically, the filtered x section 120 includes filters having the characteristics Cˆ, $\Psi^{-1}$, B and Ψ, which are connected in series. The LMS algorithm processing section 122 adjusts the filter coefficients of the adaptive filters included in the control filter 102 according to [EQ27] above based on an error signal e(n) in the time domain, which is output from the domain conversion filter 114, and the reference signal output from the filtered x section 120.

In this way, by performing mode decomposition on a sound pressure distribution and controlling the mode with a large amplitude, that is, the mode adversely influencing the transmission characteristic of the acoustic space, the transmission characteristic of the entire acoustic space can be corrected.

Figure 10:
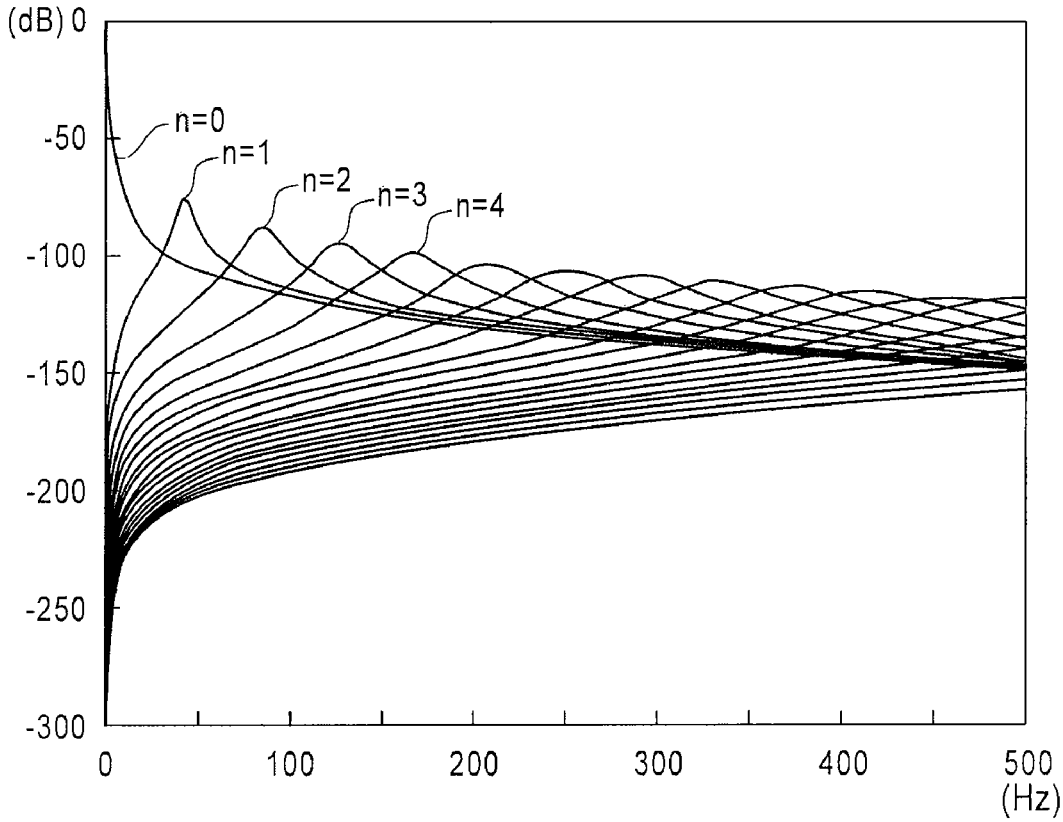
FIG. 10 illustrates frequency characteristics of modes included in an acoustic system.

Having described the example in which N' modes are subjects in general, Ψ is a matrix of 2×2 as expressed by [EQ16] where the target modes N'=2 include Order 0 and Order 1 or Order 0 and Order 2, for example. Ψ is a matrix of 3×3 where the target modes N'=3 include Order 0, Order 1 and Order 2, for example. FIG. 10 shows frequency characteristics of modes included in an acoustic system. As shown in FIG. 10, the mode amplitude increases as the number of order decreases. Therefore, by controlling the modes of lower orders only, a target acoustic characteristic can be substantially obtained, and the processing amount can be reduced. The same can be true for the second sound field control apparatus described next.

(E) Second Sound Field Control Apparatus

While the first sound field control apparatus has an algorithm by which adaptive filters operate in the time domain, the sound field control apparatus can be configured to operate according to an algorithm that operates the adaptive filters in the mode domain. For operation in the mode domain, an error calculated in the mode domain may be used for updating the coefficients of the adaptive filters directly.

Figure 11:
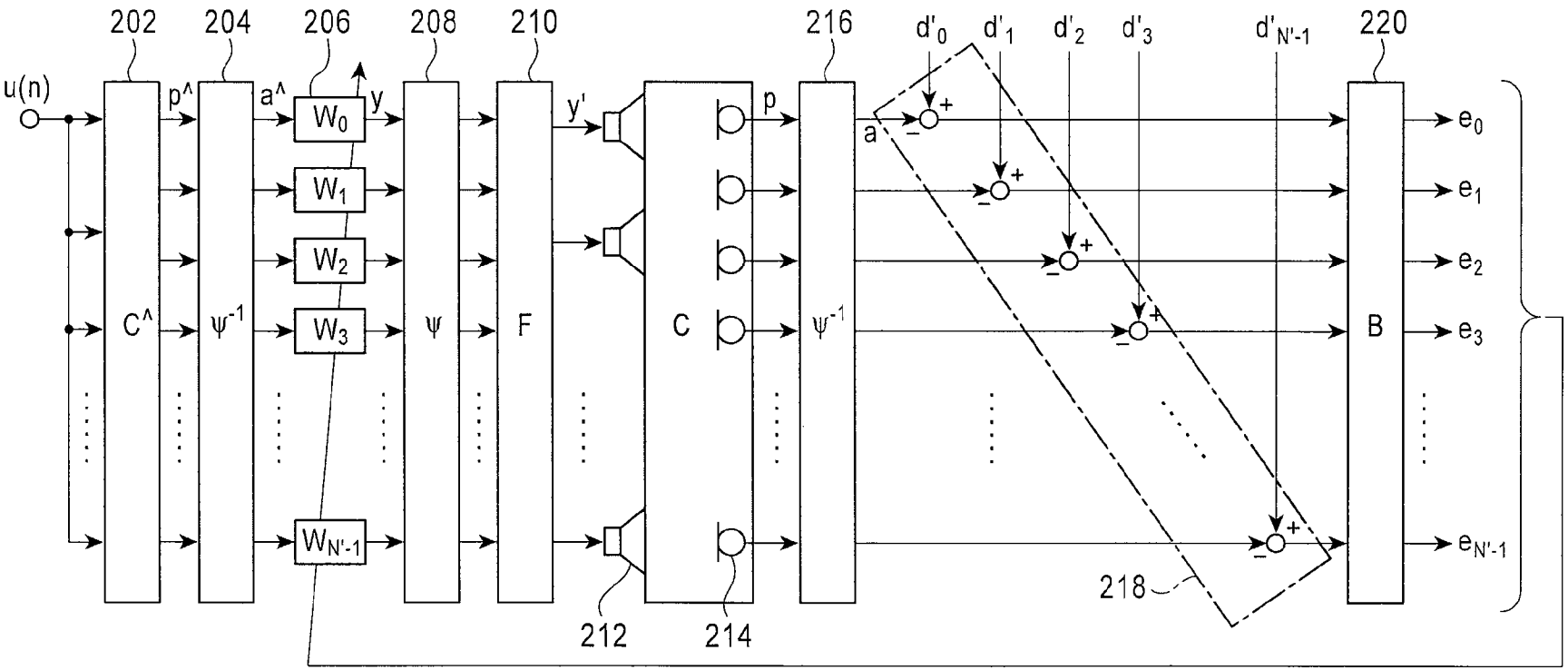
FIG. 11 is a diagram showing a schematic configuration of a second sound field control apparatus.

FIG. 11 is a diagram showing a schematic configuration of the second sound field control apparatus. As shown in FIG. 11, a sound field control apparatus according to this embodiment includes an acoustic system modeling filter 202 that simulates an acoustic system C, a mode division filter 204 that derives N' mode amplitudes from a signal (sound pressure) output from the acoustic system modeling filter 202, a control filter 206 including N' adaptive filters with I taps, a domain conversion filter 208 that converts a signal output from the control filter 206 to a signal in the time domain, an acoustic system inverse filter 210 that returns the acoustic system Cˆ simulated by the acoustic system modeling filter 202 to the original, M speakers 212, K microphones 214, a mode division filter 216 that derives N' mode amplitudes from sound pressures p of the microphones 214, N' calculating sections 218 each of which calculates an error of each mode, N' mode domain error weighting sections 220 each of which weights the error of a mode.

In operating the adaptive filters in the mode domain, the coefficient of the control filter 206 is obtained in the mode domain. Therefore, the input signal to the control filter 206 must be a signal in the mode domain. For that reason, an input signal u(n) is passed through the acoustic system modeling filter 202 having an equal characteristic as that of the real acoustic system C. Then, the mode division filter 204 converts the signal in the time domain, which is output from the acoustic system modeling filter 202, to the signal in the mode domain.

In order to actually output sound from the speakers 212, the signal to be input to the speakers 212 must be a signal in the time domain. For that reason, the domain conversion filter 208 converts the signal in the mode domain, which is output from the control filter 206, to the signal in the time domain again. The signal in the time domain, which is output from the domain conversion filter 208, is the signal passed through the acoustic system Cˆ by the acoustic system modeling filter 202 (which is a signal corresponding to the positions of the microphones 214). Therefore, by passing it through the acoustic system inverse filter 210, it can be returned to the signal corresponding to the positions of the speakers 212.

As the convolution of an input signal u(n) and an acoustic modeling filter 202, the kth output signal $p_k(n)$ of the acoustic modeling filter 202 that models the acoustic system C is expressed by:

$$\hat{p}_m(n) = \sum_{k=1}^{K} \sum_{i=0}^{I-1} \hat{c}_{km}(i)u(n-i) \quad \text{[EQ 28]}$$

Rewriting [EQ28] in a matrix expression:

$$\hat{p}(n)=\hat{C}u(n) \quad \text{[EQ29]}$$

The mode amplitude $\hat{a}(n)$ of the modeling filter output can be obtained by multiplying the output signal $\hat{p}(n)$ of the acoustic system modeling filter 202, which is obtained by [EQ29], by an inverse natural mode function $\Psi^{-1}$. Therefore, the mode division filter 204 derives the mode amplitude $\hat{a}(n)$ by the operation given by:

$$\hat{a}=\Psi^{-1}\hat{C}u(n) \quad \text{[EQ30]}$$

The mode amplitude $\hat{a}(n)$ is a signal to be input to the control filter 206. Therefore, the output signal y(n) of the control filter 206 is:

$$y(n)=W\Psi^{-1}\hat{C}u(n) \quad \text{[EQ31]}$$

[EQ31] can be rewritten to:

$$y(n)=U'(n)w \quad \text{[EQ32]}$$

Next, the domain conversion filter 208 converts the output signal y(n) of the control filter 206, which is a signal in the mode domain, to the signal in the time domain by multiplying it by a natural mode function $\Psi$. Since the signal in the time domain is a signal simulated to the acoustic system $\hat{C}$ by the acoustic system modeling filter 202, the acoustic system inverse filter 210 returns it to the original by applying the inverse filter F of the acoustic system $\hat{C}$. Therefore, the output signal y'(n) of the acoustic system inverse filter 210 is:

$$y'(n)=F\Psi U'(n)w \quad \text{[EQ33]}$$

The output signal y'(N) is input to the speakers 212, and sound is radiated to a one-dimensional sound field of the acoustic system C and is captured by the microphones 214. The sound pressure p(n) at the applicable microphone 106 is:

$$p(n)=CF\Psi U'(n)w \quad \text{[EQ34]}$$

The mode amplitude a(n) can be obtained by performing the mode decomposition in the same manner as [EQ7] on the sound pressure p(n) at the microphone 214 obtained by [EQ33]. Therefore, the mode division filter 216 derives the mode amplitude a(n) by the operation expressed by:

$$a(n)=\Psi^{-1}CF\Psi U'(n)w \quad \text{[EQ35]}$$

On the other hand, the mode amplitude d'(n) of a target response is given by:

$$d'(n)=\Psi^{-}Hu''(n) \quad \text{[EQ36]}$$

like [EQ33]. The error e'(n) in the mode domain can be obtained by subtracting the mode amplitude a(n) given by [EQ33] from the mode amplitude d'(n) of the target response given by [EQ34]. Therefore, the calculating section 218 calculates the error e'(n) in the mode domain by the operation given by:

$$e'(n)=d'(n)-\Psi^{-1}CF\Psi U'(n)w \quad \text{[EQ37]}$$

Next, the mode domain error weighting section 220 performs weighting with a weighting coefficient B on the error e'(n) in the mode domain.

$$e(n)=Bd'(n)-B\Psi^{-1}CF\Psi U'(n)w \quad \text{[EQ38]}$$

In this case, calculating an instant estimate of the gradient vector of an error performance surface by performing partial differentiation with a filter coefficient w on an instant power $e(n)^Te(n)$ of the weighted error vector e(n) in the mode domain:

$$\partial e(n)^Te(n)/\partial w=-2U'(n)^T\Psi^TF^TC^T(\Psi^{-1})^TB^Te(n) \quad \text{[EQ39]}$$

Therefore, the coefficient of the control filter 206 is updated by:

$$\begin{aligned} w(n+1) &= w(n) - \mu\{\partial e(n)^Te(n)/\partial w\} \\ &= w(n) + 2\mu U'(n)^T\Psi^TF^TC^T(\Psi^{-1})^TB^Te(n) \end{aligned} \quad \text{[EQ 40]}$$

where μ is a step size parameter of the LMS algorithm and is a coefficient that controls the magnitude of the correction in every repetition.

Figure 12:
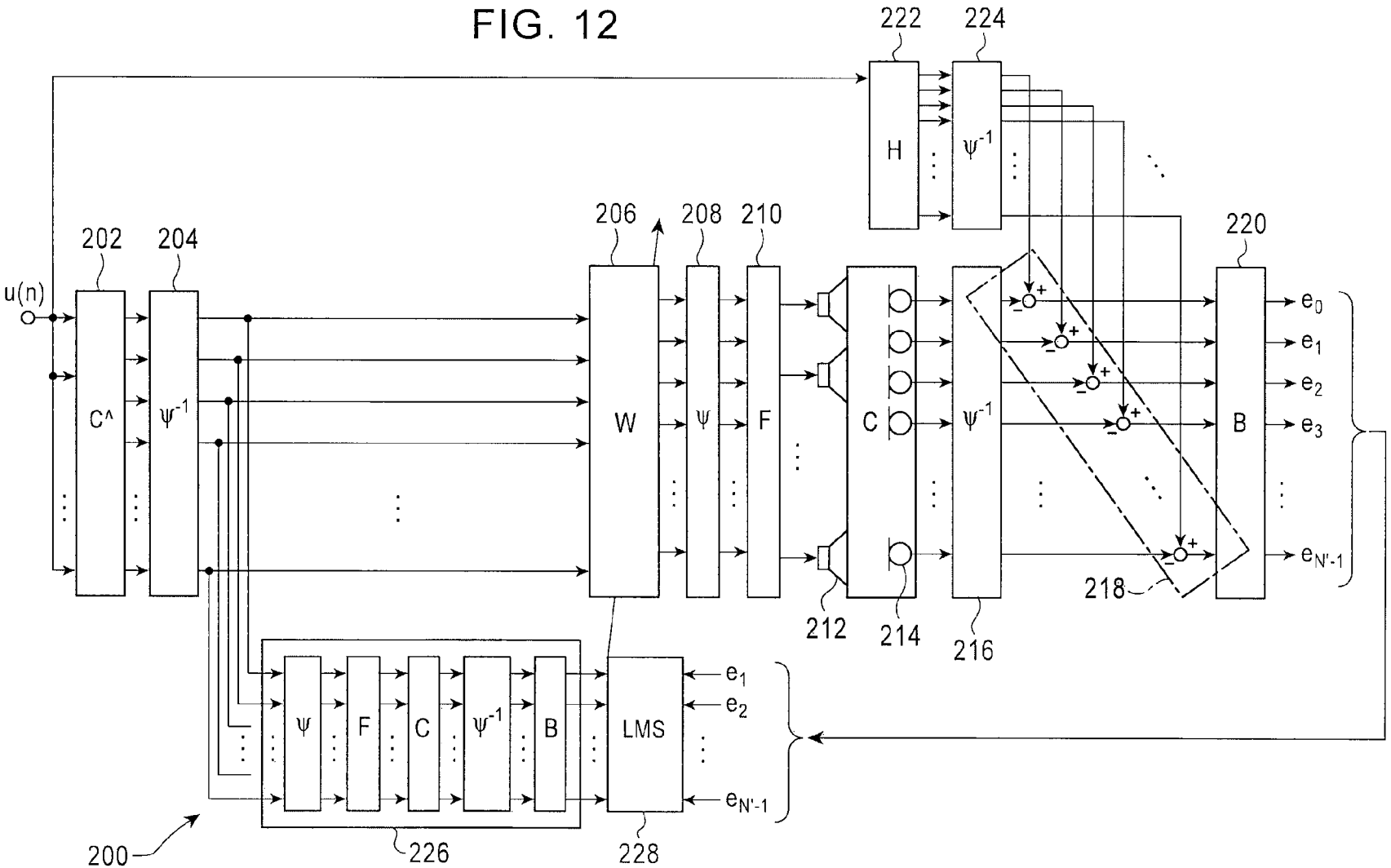
FIG. 12 is a diagram showing an entire configuration of the second sound field control apparatus.
Figure 13:
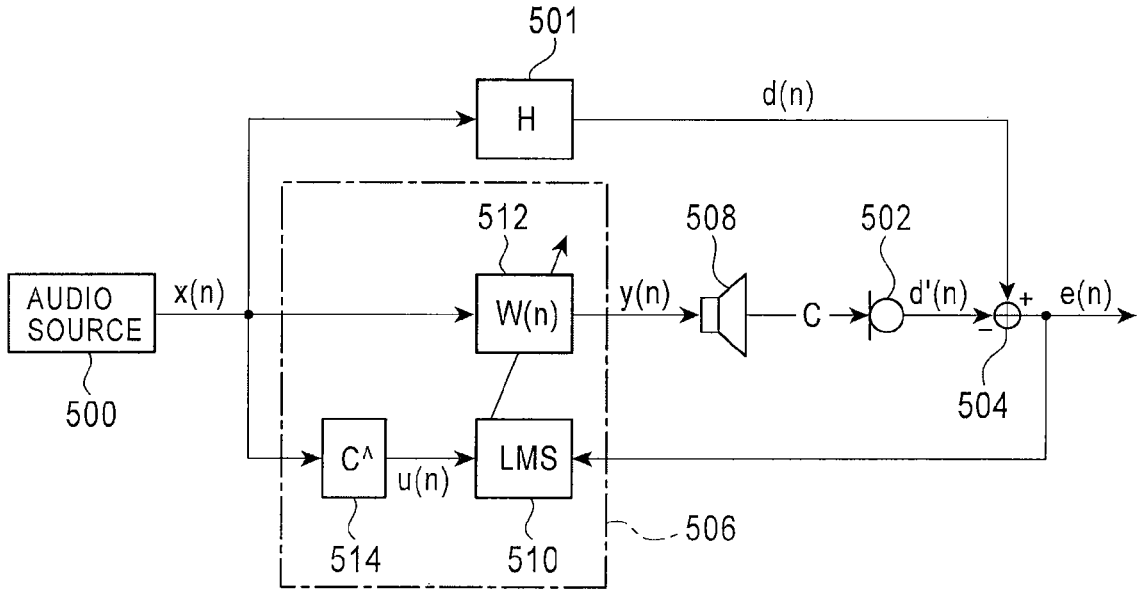
FIG. 13 is a diagram showing a configuration of an adaptive equalization system to be applied to an audio system.

Next, a detailed configuration of the second sound field control apparatus will be described. FIG. 12 is a diagram showing the entire configuration of the second sound field control apparatus. As shown in FIG. 12, a sound field control apparatus 200 includes an acoustic system modeling filter 202, a mode division filter 204, a control filter 206 including N' adaptive filters with I taps, a domain conversion filter 208, an acoustic system inverse filter 210, M speakers 212, K microphones 214, a mode division filter 216, N' calculating sections 218, N' mode domain error weighting sections 220, a target response setting section 222, a mode division filter 224, a filtered x section 226 and an LMS algorithm processing section 228.

The acoustic system modeling filter 202, mode division filter 204, control filter 206, domain conversion filter 208, acoustic system inverse filter 210, speakers 212, microphones 214, mode division filter 216, calculating sections 218 and mode domain error weighting sections 220 perform the operations described with reference to FIG. 8.

The target response setting section 222 has the setting of a characteristic corresponding to the sound field space to be reproduced (or target response characteristic H) such as a characteristic with a delay time, which is about half of the number of taps of a filter included in the acoustic system inverse filter 210. The mode division filter 224 derives N' mode amplitudes from the target response signal output from the target response setting section 222 and outputs them to the calculating section 218. The filtered x section 226 is a filter for creating a reference signal from a mode amplitude $\hat{a}(n)$, which is the output signal of the mode division filter 204. More specifically, the filtered x section 260 includes filters having the characteristics $\Psi$, C, F, $\Psi^{-1}$ and B, which are connected in series. The LMS algorithm processing section 228 adjusts the filter coefficients of the adaptive filters included in the control filter 206 according to [EQ40] above based on an error signal e(n) in the mode domain, which is output from the mode domain error weighting section 220, and the reference signal output from the filtered x section 226.

In this way, by performing control with the control filter 206 in the mode domain, the mode with a large amplitude, that is, the mode adversely influencing the transmission characteristic of an acoustic space can be controlled. Therefore, the transmission characteristic of the entire acoustic space can be corrected.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A sound field control apparatus that has multiple speakers radiating input signals to an acoustic space and multiple microphones gathering sound radiated from the multiple speakers, performs mode decomposition on a sound pressure distribution based on the output signals by the microphones, and performs control such that the mode amplitudes of modes can have a predetermined value, the apparatus comprising:

a mode decomposition filter that performs mode decomposition on a sound pressure distribution based on output signals by the multiple microphones;

a control filter that controls the input signals to be input to the multiple speakers such that the mode amplitudes of the modes decomposed by the mode decomposition filter can have a predetermined value; and a sound pressure distribution simulating section that measures a sound pressure distribution in the acoustic space, simulates a sound pressure distribution in the acoustic space by using a sinusoidal function and cosine function of a space frequency of the mode to be controlled in amplitude, and corrects the mode space frequency such that the simulated sound pressure distribution equals the measured sound pressure distribution, wherein the mode decomposition filter is based on the obtained mode space frequency.

2. The sound field control apparatus according to claim 1, wherein the sound pressure distribution simulating section comprises a means for determining amplitudes of the sinusoidal function and cosine function by using the corrected mode space frequency.

3. The sound field control apparatus according to claim 1, wherein the sound pressure distribution simulating section comprises:

a sound pressure distribution expressing section that expresses a sound pressure distribution in the acoustic space by generalized harmonic analysis by using the mode space frequency and the amplitudes of the sinusoidal function and cosine function as parameters; and a parameter determining section that corrects a mode space frequency such that the expressed sound pressure distribution can be equal to the measured sound pressure distribution and determines the amplitudes of sinusoidal function and cosine function by using the corrected mode space frequency.

4. The sound field control apparatus according to claim 1, wherein the sound pressure distribution simulating section comprises:

an impulse response measuring section that radiates measurement sound from speakers and measures impulse responses to the microphones;

a transmission characteristic obtaining section that performs Fourier transform on the impulse responses and obtains transmission characteristics;

a first sound pressure calculating section that calculates the sound pressure of the mode to be controlled in amplitude at each microphone by using the transmission characteristic;

a sound pressure distribution expressing section that expresses a sound pressure distribution in the acoustic space by generalized harmonic analysis by using the mode space frequency and the amplitudes of the sinusoidal function and cosine function as parameters;

a second sound pressure calculating section that calculates a sound pressure of the mode to be controlled in amplitude at each of the microphones by using the amplitudes of the sinusoidal function and cosine function; and a parameter determining section that corrects the mode space frequency such that the total sum of the powers of the differences in sound pressure, which are calculated by the first and second sound pressure calculating sections, at the microphones can be minimum and determines the amplitudes of the sinusoidal function and cosine function by using the corrected mode space frequency.

5. The sound field control apparatus according to claim 4, further comprising:

a mode space frequency calculating section that calculates a mode space frequency of the mode to be controlled in amplitude, wherein the parameter determining section adjusts the mode space frequency in the calculation by generalized harmonic analysis within a predetermined range including the calculated mode space frequency, obtains a mode space frequency such that the total sum of the powers can be minimum, and handles the mode space frequency as the corrected mode space frequency.

6. The sound field control apparatus according to claim 4, further comprising a mode center frequency calculating section that calculates the mode center frequency of the mode to be controlled in amplitude, wherein the first sound pressure calculating section calculates a real part and an imaginary part of the transmission function at the mode center frequency of the mode to be controlled in amplitude and, if the real part is positive, outputs the square root of the sum of the squares of the real part and the imaginary part as a positive sound pressure and, if it is negative, outputs the square root as a negative sound pressure.

7. The sound field control apparatus according to claim 4, further comprising:

a mode center frequency calculating section that calculates the mode center frequency of the mode to be controlled in amplitude, wherein the first sound pressure calculating section comprises:

a mode center frequency correcting section that obtains a frequency at which the difference in sound pressure among the microphones can be maximum in a predetermined frequency range, which is lower than the mode center frequency, and corrects the mode center frequency with the frequency; and a sound pressure calculating section that calculates a real part and an imaginary part of the transmission function at the corrected mode center frequency and, if the real part is positive, outputs the square root of the sum of the squares of the real part and the imaginary part as a positive sound pressure and, if it is negative, outputs the square root as a negative sound pressure.

8. A sound field control method that has multiple speakers radiating input signals to an acoustic space, multiple microphones gathering sound radiated from the multiple speakers, a mode decomposition filter that performs mode decomposition on a sound pressure distribution based on the output signals by the multiple microphones, and a control filter that controls the input signals to be input to the multiple speakers such that the mode amplitudes of the modes decomposed by the mode decomposition filter can have a predetermined value, the method comprising:

a first act of measuring a sound pressure distribution in the acoustic space;

a second act of simulating a sound pressure distribution in the acoustic space by using a sinusoidal function and cosine function of a space frequency of the mode to be controlled in amplitude;

a third act of correcting the mode space frequency such that the simulated sound pressure distribution equals the measured sound pressure distribution; and a fourth act of creating the mode decomposition filter based on the mode space frequency obtained by the correction.

9. The sound field control method according to claim 8, further comprising the act of determining amplitudes of the sinusoidal function and cosine function by using the corrected mode space frequency.

10. The sound field control method according to claim 8, wherein the second act expresses a sound pressure distribution in the acoustic space by generalized harmonic analysis by using the mode space frequency and the amplitudes of the sinusoidal function and cosine function as parameters; and the third act corrects a mode space frequency such that the expressed sound pressure distribution equals the measured sound pressure distribution and determines the amplitudes of sinusoidal function and cosine function by using the corrected mode space frequency.

11. The sound field control method according to claim 8, wherein the first act includes:

an impulse response measuring act of radiating measurement sound from speakers and measuring impulse responses to the microphones;

a transmission characteristic obtaining act of performing Fourier transform on the impulse responses and obtaining transmission characteristics; and a first sound pressure calculating act of calculating the sound pressure of the mode to be controlled in amplitude at each microphone by using the transmission characteristic;

the second act includes:

a sound pressure distribution expressing act of expressing a sound pressure distribution in the acoustic space by generalized harmonic analysis by using the mode space frequency and the amplitudes of the sinusoidal function and cosine function as parameters; and the third act includes:

a second sound pressure calculating act of calculating a sound pressure of the mode to be controlled in amplitude at each of the microphones by using the amplitudes of the sinusoidal function and cosine function;

a parameter determining act of correcting the mode space frequency such that the total sum of the powers of the differences in sound pressure, which are calculated by the first and second sound pressure calculating acts, at the microphones can be minimum and determining the amplitudes of the sinusoidal function and cosine function by using the corrected mode space frequency.

12. The sound field control method according to claim 11, further comprising:

a mode space frequency calculating act of calculating a mode space frequency of the mode to be controlled in amplitude, wherein the mode space frequency correcting act adjusts the mode space frequency in the calculation by generalized harmonic analysis within a predetermined range including the calculated mode space frequency, obtains a mode space frequency such that the total sum of the powers can be minimum, and handles the mode space frequency as the corrected mode space frequency.

13. The sound field control method according to claim 11, further comprising a mode center frequency calculating act of calculating the mode center frequency of the mode to be controlled in amplitude, wherein the first sound pressure calculating act includes:

the act of calculating a real part and an imaginary part of the transmission function at the mode center frequency of the mode to be controlled in amplitude and;

the act of, if the real part is positive, outputting the square root of the sum of the squares of the real part and imaginary part as a positive sound pressure and, if the real part is negative, outputting the square root as a negative sound pressure.

14. The sound field control method according to claim 11, further comprising a mode center frequency calculating act of calculating the mode center frequency of the mode to be controlled in amplitude, wherein the first sound pressure calculating act includes:

a mode center frequency correcting act of obtaining a frequency at which the difference in sound pressure among the microphones can be maximum in a predetermined frequency range, which is lower than the mode center frequency, and correcting the mode center frequency with the frequency; and the act of calculating a real part and an imaginary part of the transmission function at the corrected mode center frequency and;

the act of, if the real part is positive, outputting the square root of the sum of the squares of the real part and the imaginary part as a positive sound pressure and, if the real part is negative, outputting the square root as a negative sound pressure.

15. The sound field control method according to claim 11, further comprising:

a mode center frequency calculating act of calculating the mode center frequency of the mode to be controlled in amplitude, wherein the first sound pressure calculating act includes:

a mode center frequency correcting act of obtaining a frequency at which the difference in sound pressure among the microphones can be maximum in a predetermined frequency range, which is lower than the mode center frequency, and handling the frequency as the mode center frequency; and the act of calculating a real part and an imaginary part of the transmission function at the corrected mode center frequency and;

the act of, if the real part is positive, outputting the square root of the sum of the squares of the real part and the imaginary part as a positive sound pressure and, if the real part is negative, outputting the square root as a negative sound pressure.

* * * * *